US005928835A

United States Patent [19]

Hirabayashi et al.

[11] Patent Number: 5,928,835

[45] **Date of Patent: *Jul. 27, 1999**

[54] METHOD OF PROCESSING SILVER HALIDE LIGHT-SENSITIVE PHOTOGRAPHIC MATERIAL

[75] Inventors: Kazuhiko Hirabayashi; Katsushi Fujita, both of Hino, Japan

[73] Assignee: Konica Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/680,163

[22] Filed: Jul. 15, 1996

[30] Foreign Application Priority Data

Jul. 21, 1995 [JP] Japan ..... 7-185750

[51] Int. Cl.[6] ..... G03C 1/06

[52] U.S. Cl. ..... 430/265; 430/264; 430/963

[58] Field of Search ..... 430/264, 265, 430/963, 428, 434

[56] References Cited

U.S. PATENT DOCUMENTS 5,103,253 4/1992 Uchiyama .
5,229,248 7/1993 Sanpei et al. ..... 430/264

FOREIGN PATENT DOCUMENTS 0 316 864 5/1989 European Pat. Off. .
27 10 879 9/1978 Germany .

OTHER PUBLICATIONS

Derwent Publications Ltd., Abstract No. AN 96–024159 of JP–A–07 295 165 (1995).
Derwent Publications Ltd., Abstract No. AN 92–013769 of JP–A–03 264 953 (1991).

*Primary Examiner*—Thorl Chea
*Attorney, Agent, or Firm*—Frishauf, Holtz, Goodman, Langer & Chick, P.C.

[57] ABSTRACT

A method of processing a silver halide photographic light-sensitive material is disclosed, comprising a support having on one side of the support a silver halide emulsion layer and, on both sides, a hydrophilic colloid layers, the processing method comprising the steps of developing an exposed photographic material, fixing, and washing or stabilizing, wherein at least one layer of the emulsion side contains a compound represented by the following formula; and the layer(s) of each side having a processing water content of 0.5 to 7.0 g per $m^2$

6 Claims, 3 Drawing Sheets

METHOD OF PROCESSING SILVER HALIDE LIGHT-SENSITIVE PHOTOGRAPHIC MATERIAL

FIELD OF THE INVENTION

The present invention relates to a method for processing a silver halide light-sensitive photographic material used in lithographic printing plate making.

BACKGROUND OF THE INVENTION

Silver halide light-sensitive photographic materials for black-and-white photography, and especially photographic materials for lithography are usually processed after exposure with an automatic processor which comprises a developing section, a fixing section, a washing section or a stabilizing section and a drying section.

Processing of light-sensitive photographic materials for lithography by the use of an automatic processor has heretofore usually been carried out over 80 to 100 seconds. However, as a contact film, they are still insufficient in tone reproduction and paste-up mark. Therefore, further improvements in these respects are being researched.

To have good tone reproduction means that, in a process of a dot image output from a scanner being contact-printed on a light-sensitive photographic material, 95% halftone dots come to be 5% dots, when 5% halftone dots are contact-printed so as to become 95% dots. However, in the case when a conventional light-sensitive photographic material is employed and subjected to processing, this is usually not the case. In actuality, when 5% dots are to become 95% dots, 95% dots usually turns out to be dots of less than 5%.

Moreover, the term "pasting-up mark" means that in the process of superimposing a text original on a halftone original, and contact-printing them on a photographic material, light scattering takes place at the edge surface portion of the original, leaving an undeveloped portion. Heretofore, in order not to leave this portion, increased exposure has been employed. However, increased exposure has caused a problem that images and small letters tended to be squashed.

SUMMARY OF THE INVENTION

Accordingly, an object of the present invention is to provide a silver halide light-sensitive photographic material for use in a plate-making process, particularly in contact printing, improved in tone reproduction and paste-up mark, and a processing method thereof.

The above-mentioned object of the invention have been attained by the following:

(1) In a method of processing a silver halide light-sensitive photographic material comprising a support having on one side thereof at least one silver halide emulsion layer and on both sides at least one hydrophilic colioid layer, at least one of the silver halide emulsion layer and hydrophilic colloid layer comprises a compound represented by the following general formula (H), and a processing water content of the layers coated on each side of the support during processing is from 0.5 to 7.0 $g/m^2$.

Formula (H)

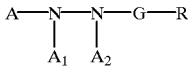

In the formula, A represents an aryl group or a heterocycle containing therein a sulfur atom or oxygen atom; G represents a $—(CO)_n—$ group, a sulfonyl group, a sulfoxy group, a $—P(=O)R_2$ group or an iminomethylene group, in which n is 1 or 2; $A_1$ or $A_2$ both represent hydrogen atoms, or one of $A_1$ and $A_2$ represents a hydrogen atom and the other represents a substituted or unsubstituted alkylsulfonyl group, or a substituted or unsubstituted acyl group; R represents a hydrogen atom, or an alkyl group, alkenyl group, aryl group, alkoxy group, alkenyloxy group, aryloxy group, heterocyclic oxy group, amino group, carbamoyl group or oxycarbonyl group, each of which may be substituted; and $R_2$ represents an alkyl group, alkenyl group, alkynyl group, aryl group, alkoxy group, alkenyloxy group, alkynyloxy group, aryloxy group, or amino group, each of which may be substituted.

(2) The method of processing a silver halide light-sensitive photographic material described in (1), wherein said photographic material is processed with an automatic processor within 10 to 50 seconds of the total processing time including development through drying.

(3) The method of processing a silver halide light-sensitive photographic material described in (2), wherein the automatic processor comprises a developing bath, a fixing bath, a washing bath or stabilizing bath, and a drying section in this order; guide plates being provided respectively between an inlet for film insertion and the developing bath, between the developing bath and the fixing bath, between the fixing bath and the washing or stabilizing bath, and between the washing or stabilizing bath and the drying section and at least one of the guide plates having a sliding friction of 10 to 1000 g.

(4) The method of processing a silver halide light sensitive photographic material described in (2) or (3), wherein a hot-air quantity of the drying section is 6 to 60 $m^3$/min.

(5) The method of processing a silver halide light-sensitive photographic material described in any one of (2) through (4), wherein, a temperature in the drying section of the automatic processor is from 5 to 60° C.

DETAILED DESCRIPTION OF THE INVENTION

Figure 1:
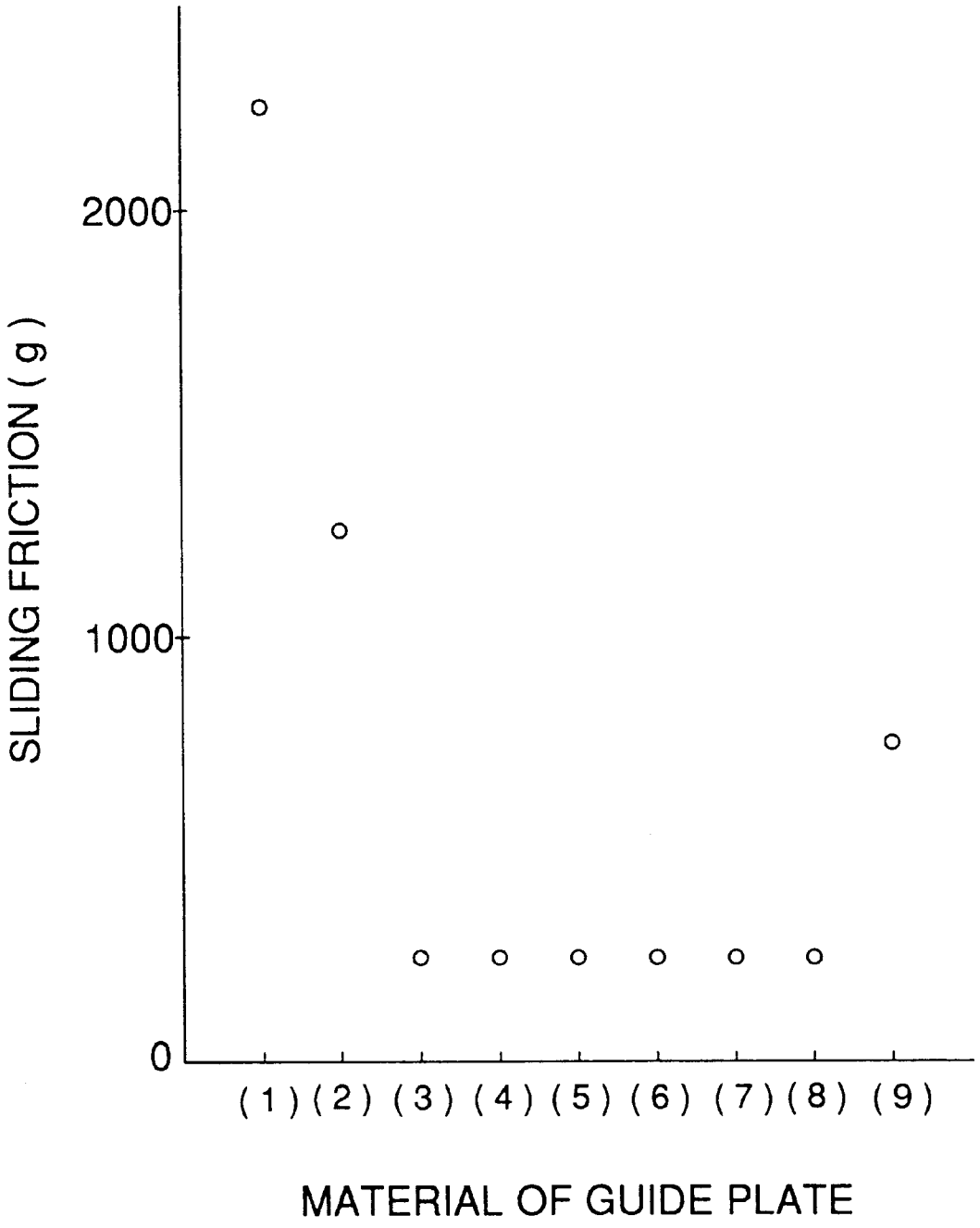
FIG. 1 shows sliding friction of guide plate materials.

In the present invention, the processing water content of the layers provided on each side of the support is 7.0 $g/m^2$ or less, and, preferably, from 1.0 $g/m^2$ to 6.0 $g/m^2$. Herein, the word, "processing water content" is defined as below, Thus, the processing water content means ability of containing water of the light-sensitive material and it can be determined according to the following procedure.

(1) Hydrophilic colloid layer(s) provided on either emulsion-side or back-side of an unexposed light-sensitive photographic material (7.5 cm×12.5 cm in size) are removed by using an aqueous solution of sodium hypochlorite and then the light-sensitive material is dipped in a developer, CDM671 (a product of Konica Corporation) at 35° C. for 10 seconds.

(2) Next, the light-sensitive material is dipped in a fixer, CFL871 (a product of konica Corporation) at 35° C. for 10 seconds.

(3) The light-sensitive material is further dipped in tap water at 25° C. for 10 seconds.

(4) The light-sensitive material is sandwiched between two sheets of paper and then passed through between a pair of rotating rollers made of bakelite (line speed at 3,700 mm/min), to wipe off water on the surface.

(5) The light-sensitive material is sandwiched between acrylic plates to prevent evaporation of moisture, and then its weight is measured.

(6) Next, the light-sensitive material is dried and its weight is measured.

(7) The amount of water contained in the layers on both side is determined based on the following relation;

Weight of water={weight of (5)−weight of the acrylic plates−weight of (6)}.

The water content is determined by converting the obtained value to g per $m^2$ of the light-sensitive material.

The developer and fixer solutions used are as follows.

| Developer: CDM 671: | | |
|---|---|---|
| Composition A | | |
| Water | 150 | ml |
| Disodium ethylenediaminetetraacetate | 2 | g |
| Diethylene glycol | 50 | g |
| Potassium sulfite (50% aq. solution) | 100 | ml |
| Potassium carbonate | 50 | g |
| Hydroquinone | 15 | g |
| 5-Methylbenzotriazole | 200 | mg |
| 1-Phenyl-5-mercaptotetrazole | 30 | mg |
| Potassium bromide | 4.5 | g |
| Composition B | | |
| Water | 3 | ml |
| Diethylene glycol | | |
| Disodium ethylenediaminetetraacetate | 2 | g |
| Acetic acid (90% aq. solution) | 0.3 | ml |
| 5-Nitroindazole | 110 | mg |
| 1-Phenyl-3-pyrazolidone | 500 | mg |

Compositions A and B are dissolved in water of 500 ml in this order and further thereto is added water to make 1 liter of a working developer solution. The pH is adjusted to 10.9 with potassium hydroxide.

| Fixer CFL 871: | | |
|---|---|---|
| Composition A | | |
| Ammonium thiosulfate (72.5% aq. solution) | 230 | ml |
| Sodium sulfite | 9.5 | g |
| Sodium acetate trihydride | 15.9 | g |
| Boric acid | 6.7 | g |
| Sodium citrate dihydride | 2 | g |
| Acetic acid (90% aq. solution) | 8.1 | ml |
| Composition B | | |
| Water | 17 | ml |
| Sulfuric acid (50% solution) | 5.8 | g |
| Aluminum sulfate (8.1% aq. solution) | 26.5 | g |

Compositions A and B are dissolved in water of 500 ml in this order and further thereto is added water to make 1 liter of a working fixer solution. The pH is 4.3.

Herein, in the step (4), interleaving paper (product by Tokushuseishi Co.), for use in X-ray films was used to wipe off water on the surface of the light-sensitive material. A pair of the rollers were nipped with each other by suspending both sides thereof with a spring having a force of 200 g. In the step (6), the light-sensitive material was dried at 40° C. and 20% R. H. for 6 hrs. The water content of 0.7 g/$m^2$ or less can be achieved, for example, by decreasing the amount of a hydrophilic binder, surface-coating of a hydrophobic binder or increased use of hardening agent, however, the applicable embodiments are not limited to these.

Next, the guide employed in the automatic processor used in the invention is explained.

Figure 2:
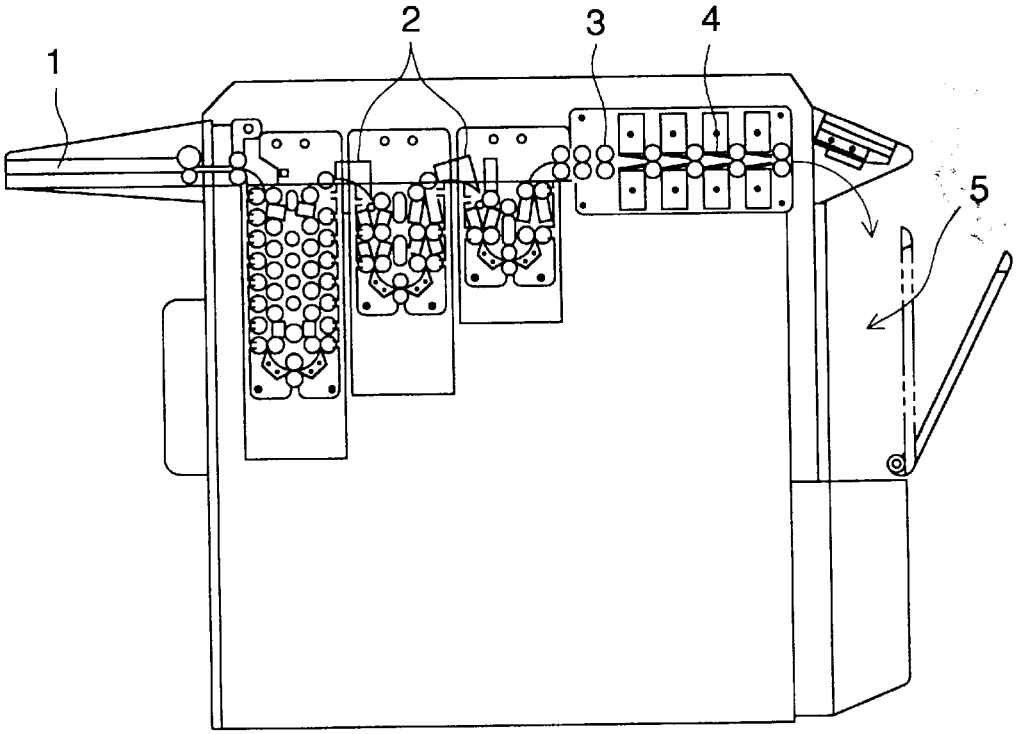
FIG. 2 illustrates cross-sectional view of a automatic processor.

FIG. 2 illustrates a cross-sectional view of the automatic processor used in the present invention. In FIG. 2, numerical symbols respectively denote as follows:

1; Film inserting table

2; Cross-over guide

3; Squeezing roller

4; Drying nozzle and

5; Film-receiving section.

Figure 3:
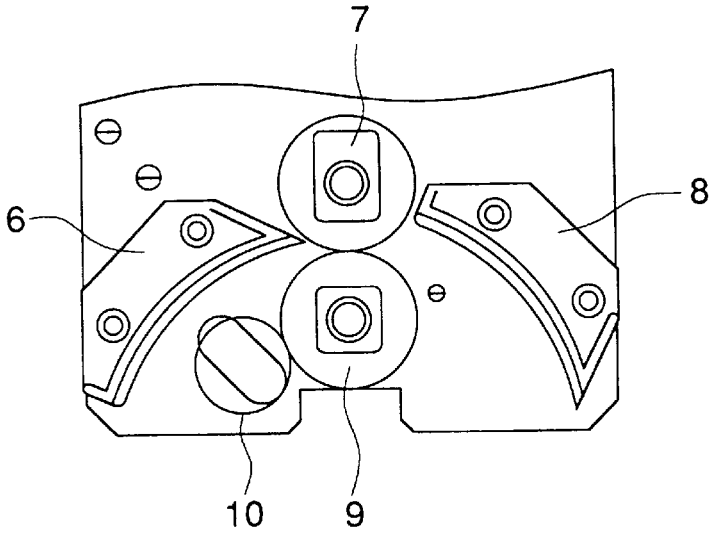
FIG. 3 illustrates cross-sectional view of a guide plate.

FIG. 3 illustrates an enlarged cross-sectional view of the guide portion in the automatic processor. In FIG. 3, numerical symbols respectively denote as follows:

6 and 8; Guides

7; Upper cross-over roller

9; Lower cross-over roller

10; Transfer roller

Figure 4:
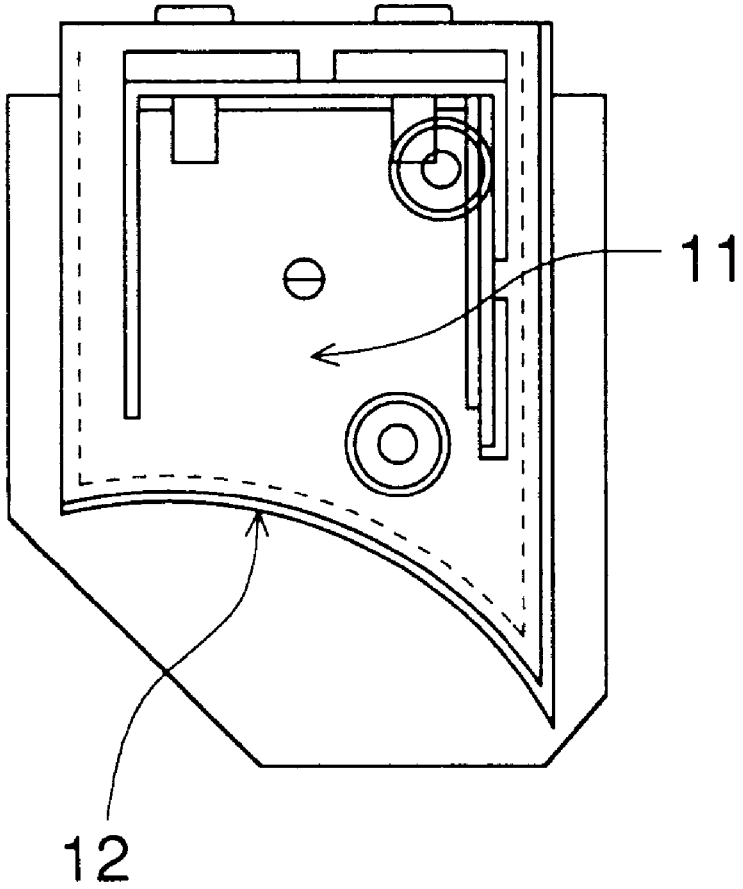
FIG. 4 illustrates cross-sectional view of a guide plate.

FIG. 4 illustrates an enlarged cross-sectional view of the guide portion. In FIG. 4, numerical symbol 11 denotes a cross-over guide and 12 denotes the guide-surface.

On the opposite side of the support of the silver halide light-sensitive photographic material used according to the present invention with respect to the silver halide emulsion layer, it is preferable to provide an adhesion layer, an anti-static layer, a backing layer containing a hydrophilic colloid and/or a hydrophobic polymer layer. Still further thereon, a protective layer may be provided. The adhesion layer can be obtained by coating vinyliudene chloride copolymer or styrene-glycidylacrylate copolymer with a thickness at 0.01 μm to 1 μm on a support which has been subjected to corona discharge treatment and further thereon a gelatin layer containing fine particles of tin oxide or vanadium pentoxide with the average diameter from 0.01 mm to 1 μm and doped with indium or phosphorus. Also, there may be coateded styrene sulfonic acid-maleic acid copolymer hardened with the above-mentioned aziridine or a carbonyl-activated cross-linking agent. A dye backing layer may be provided on the anti-static layer. In these layers, an inorganic filler such as colloidal silica for dimensional stability, matting agent such as silica or methyl methacrylate for adhesion prevention, silicon-type lubricant for controlling transport, an anti-molding agent, etc. may be incorporated.

The hydrophobic polymer layer used according to the invention is a layer containing a hydrophobic polymer as a binder. As the binder in the polymer layer, for example, polyethylene, polypropyrene, polystyrene, polyvinyl chloride, polyvinylidene chloride, polyacrylonitrile, polyvinyl acetate, urethane resins, urea resins, melamine resins, phenol resins, epoxy resins; fluorinated resins such as tetrafluoroethylene, polyvinylidene fluoride, etc.; rubbers such as butadiene rubber, chloroprene rubber, natural rubber, etc.; acrylates or methacrylates such as such as polymethyl methacrylate, polyethyl acrylate, etc.; polyester resins such as poplyethylene terephthalate; polyamide resins such as nylon-6, nylon-66, etc.; cellulose resins such as cellulosetriacetate, etc.; water-insoluble polymers such as silicone resins or derivatives of these resins can be mentioned. As the binder used in the polymer layer, it may be either a homopolymer consisting of a single kind of monomer or a copolymer consisting of two or more kinds of monomers. As especially preferable binders, for example, copolymers of alkylacrylate or alkyl methacrylate and acrylic acid or methacrylic acid(preferable proportion of acrylic acid or methacrylic acid is less than 5 mol %); styrene-butadiene copolymers; styrene-butadiene-acrylic acid copolymers(preferable proportion of acrylic acid or methacrylic acid is less than 5 mol %); styrene-butadiene-divinyl benzene-methacrylic acid copolymers(preferable proportion of methacrylic acid is less than 5 mol %); vinyl acetate-ethylene-acrylic acid copolymers(preferable proportion of acrylic acid is less than 5 mol %); vinylidene chloride-acrylonitrile-methyl methacrylate-ethyl acrylate-acrylic acid copolymers (preferable proportion of acrylic acid is less than 5 mol %); ethyl acrylate-glycidyl methacrylate-acrylic acid copolymers(preferable proportion of acrylic acid is less than 5 mol %); ethyl acrylate-glycidyl methacrylate-acrylic acid copolymer, etc. can be mentioned. These copolymers may be used either singly or two or more kinds in combination.

In the hydrophobic polymer layer, if necessary, other photographic additives such as a matting agent, a surface activating agent, a dye, a slipping agent, a cross-linking agent, a viscosity increasing agent, a UV-ray absorbent, inorganic fine particles such as colloidal silica, etc. can be incorporated. Concerning these additives, for example, disclosure in the Research Disclosure Vol. 176, Item No. 17646 (December 1978), etc. can be referred to.

The hydrophobic polymer layer may consist of either a single layer or a plurality of layers. There is no specific limitation with respect to the thickness of the polymer layer according to the present invention. However, when the thickness of the hydrophobic polymer layer is too small, water-resistance of the hydrophobic polymer layer becomes insufficient, leaving a tendency that the backing layer swells with a processing solution. When, on the other hand, the thickness of the hydrophobic colloid layer is toolarge, vapor perviousness of the polymer layer becomes insufficient, leading to a curling trouble due to hindrance of hygroscopic property of the hydrophilic layer in the backing layer. Since, of course, the thickness of the hydrophobic polymer layer is necessarily dependent on the nature or physical properties of the employed binder and, accordingly, the thickness of the polymer layer must be determined taking these points into account. Preferably thickness of the polymer layer is, although it may be varied depending on the kind of binder used in the polymer layer, from 0.05 $\mu$m to 10 $\mu$m and, more preferably, from 0.1 to 5 $\mu$m. In the case when the hydrophobic polymer layer according to the present invention consists of two ore more layers, the total thickness of the all hydrophobic polymer layers is defined to be the thickness of the hydrophobic polymer layer of the silver halide light-sensitive photographic material according to the present invention.

There is no specific limitation as to the manner of providing the hydrophobic polymer layer. The backing layer may be coated and dried and further thereon, the polymer layer may be coated and dried, or the backing layer and the polymer layer may be coated simultaneously, and then dried. The hydrophobic polymer layer may be coated either by dissolving it in a solvent for the binder of used in the polymer layer or it may be coated in the form of an aqueous dispersion of the binder polymer.

The backing layer comprises a backing dye, and for the backing dye, benzilidene dyes or oxonol dyes can be used. These alkali-soluble or alkali-decomposable dyes may be fixed in the form of fine particles. For the purpose of preventing halation, a density thereof is preferably from 1.0 to 2.0 within a photosensitive wavelength region.

In the silver halide emulsion layer and the hydrophilic colloid layer of the silver halide light-sensitive photographic material according to the present invention, inorganic or organic hardener can be incorporated as a crosslinking agent for a hydrophilic colloid such as gelatin. For example, cromium salts such as chromium alum, chromium acetate, etc.; aldehydes such as formaldehyde, glyoxal, glutalaldehyde, etc.; N0-methylol urea, methylolmethyl hydantoin, etc.; dioxane derivatives such as 2,3-dihydroxy dioxane, etc.; active vinyl compounds such as 1,3,5-triacroyl-hexahydro-s-triazine, bis(vinylsulfonyl)methyl ether, N,N'-methylenebis-[β-(vinylsulfonyl)propionamide], etc.; acetic halogeno compounds such as 2,4-dichloro-6-hydroxy-s-trriazine, etc.; mucohalogen acids such as mucochloric acid, phenoxymucochloric acid, etc.; isoxazoles, dialdehyde starch, 2-chloro-6-hydroxytriazinylized gelatin, carboxyl group-activated hardening agents, etc. can be used either singly or in combination. These hardening agents are disclodsed in the Research Disclosure(RD)No. 17643 (published in February 1978), Sectionss A through C on page 26. Among these, especially preferable examples are carboxyl group-activated type hardeners represented by the general formulae(1) thorough (7) on pages 3 through 5 in Japanese patent O.P.I. Publication No. 5-289219(1993), and, to be more specific, Exemplified Compounds H-1 through H-39 disclosed on pages 6 through 14 of the same are cited. A hardening agent represented by the following formula (K) is preferably used.

General Formula (K)

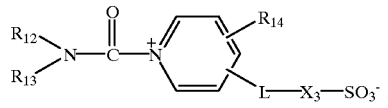

In the general formula (K), $R_{12}$, and $R_{13}$ independently represent straight chain, branched or a cyclic alkyl group having 10–20 carbon atoms, for example, methyl group, ethyl group, butyl group, cyclohexyl group, 2-ethylhexyl group, dodecyl group, etc.; an aryl group of 6–20 carbon atoms such as phenyl group, naphthyl group, etc. can be mentioned. Moreover, R12 and $R_{13}$ may have a substituent, and for the substituent, those mentioned as substituents for $R_1$ through $R_{11}$ of the compounds represented by the general formulae(1) through (6) disclosed in Japanese Patent O.P.I. Publication 5-28921(1993) can be cited. Further, it is also preferable that $R_{12}$ and $R_{13}$ is combined with each other to form a ring together with a nitrogen atom, and especially preferable rings are a morphorine ring or a pyrolidine ring; $R_{14}$ represents a hydrogen atom or a substituent as the example of such substituents. Those mentioned as the substituents for R1 through $R_{11}$ in the compounds represented by the general formulae[1] through [6] disclosed in Japanese patent O.P.I. Publication No. 5-289219(1933) are cited. However, hydrogen is particularly preferable. L represents not only a single bond but also an alkylene group with 1–20 carbon atoms, such as methylene group, ethylene group, trimethylene group, propylene group, etc.; or an arylene group with 6–20 carbon atoms, for example, phenylene group, etc. and a divalent group obtained by combining these groups such as p-xylene group, etc.; an acylamino group, such as a —$NHCOCH_2$— group, etc. can be mentioned. Preferably, it is a single bond, an alkylene group or an acylamino group. $X_3$ represaents a single bond, —O— or —N($R_{15}$), in which $R_{15}$ is a hydrogen atom, an alkyl group with 1–20 carbon atoms, such as methyl group, ethyl group, benzyl group. etc.; or an aryl group of carbon atoms of 6–20, such as phenyl group, etc. or an alkoxy group of 1–20 carbon atoms, such as methoxy group, etc., and among these, hydrogen atom is particularly preferable. Specific examples of the preferable hardening agents are given below.

K-1

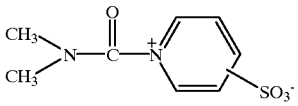

K-2

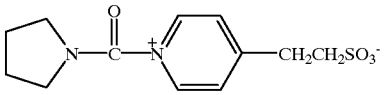

K-3

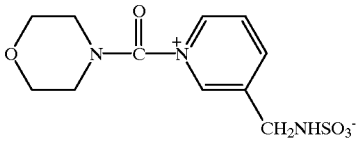

K-4

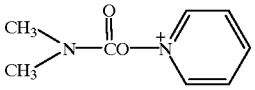

K-5

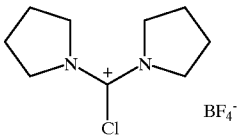

K-6

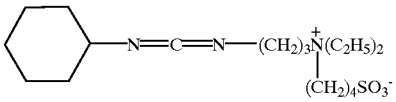

K-7

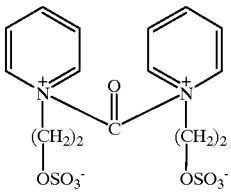

K-8

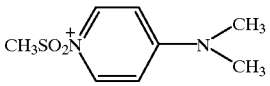

K-9

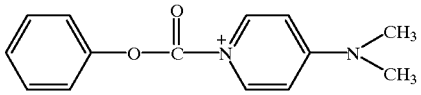

-continued

K-10

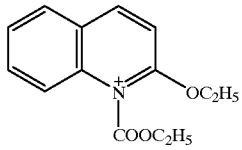

In addition, compounds which are preferably usabpe as hardening agents are, exemplified Compounds (1) through (17) disclosed on pages 11 through 13 in Japnese Patent Application No. 6-144823(1994).

One aspect of the present invention is that the total processing time from developing to drying (Dry to Dry) by the use of an automatic processor is within 50 seconds.

Processing times of the respective processing steps may optionally be chosen; however, each of a development time, fixing time, washing time and drying time is preferably 15 secor less. A period of processing time of the respective steps is defined as a period of time between a moment when the light-sensitive material comes into a processing step and a moment when it comes into the next processing step.

Next, the compound represented by formula (H), used in the silver halide emulsion layer and/or the hydrophilic colloidal layer is explained.

In the present invention, as hydrazine derivatives, the compound represented by the above-mentioned general formula H is preferable and the compound represented by the following general formula (Ha) is particularly preferable.

General Formula (Ha)

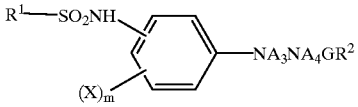

In the formula, $R^1$ represents an aliphatic group, for example, octyl group, decyl group, etc,; an aromatic group, for example, phenyl group, 2-hydroxylphenyl group, chlorophenyl group, etc.; or a heterocyclic group, for example, a pyridyl group, a thienyl group, a furyl group, etc.; and these groups may be substituted by an appropriate substituent. Further, it is also preferable that $R^1$ contains at least one ballast group or a silver halide adsorption-accelerating group.

As a diffusion-proof group, a ballast groups which are commonly used in the immobile photographic additives such as couplers are preferable, and for such ballast groups, for example, an alkyl group, an alkenyl group, an alkynyl group, an alkoxy group, a phenyl group, a phenoxy group, an alkylphenoxy group, etc., which are relatively photographically inert, are cited.

The silver halide adsorption-accelerating agent includes, for example, a thiourea group, a thiourethane group, a mercapto group, a thioether group, a thione group, a heterocyclic group, a thioamide heterocyclic group, mercapto heterocyclic group, or those adsrping groups disclosed inb Japanese Patent O,P.I. Publication No. 64-90439(1989), etc.

In the general formula (Ha), X represent a group which is capable of being a substituent on a phenyl group, m representa an integer of zero through four, provided when m is two or more, X may be the same or different.

In the formula Ha, $A_3$ and $A_4$ independently have the same definition as A1 and A2, respectively.

In the formula (Ha), G represents a carbonyl group, a sulfonyl group, a sulfoxy group, a phosphoryl group or an iminomethylene group, and carbonyl group is preferable as G.

In the formula (Ha), $R^2$ represents a hydrogen atom, an alkyl group, an alkenyl group, an alkynyl group, an aryl group, a heterocyclic group, an alkoxy group, a hydroxy group, an amino group, a carbamoyl group, a —CON($R^4$)($R^5$) group, etc. can be mentioned. ($R^3$ represents an alkenyl group or a saturated heterocyclic group; $R^4$ represents a hydrogen atom, an alkyl group, an alkenyl group, an alkynyl group, an aryl group or a heterocyclic group; and $R^5$ represents an alkenyl group, an alkynyl group, a saturated heterocyclic group,a hydroxy group or an alkoxy group.

Specific examples of the compound represented by the general formula (H) are given below, however, the scope of the present invention is limited by these.

H-1

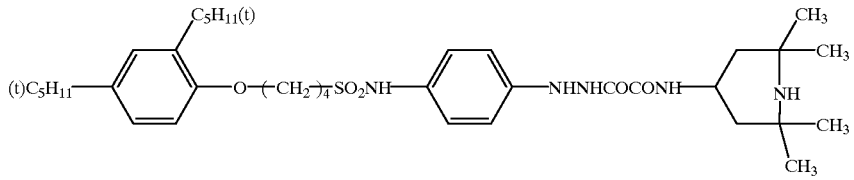

H-2

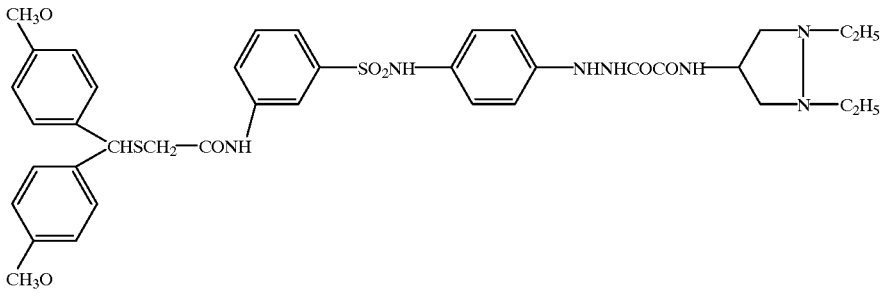

H-3

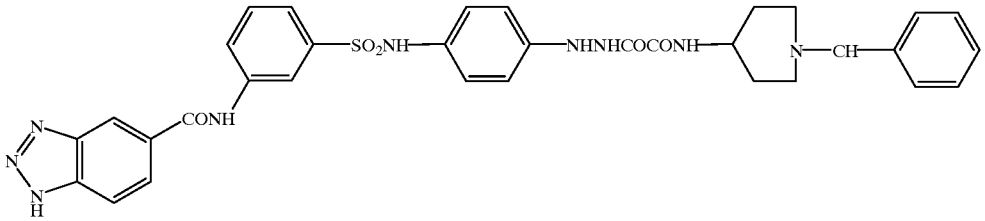

H-4

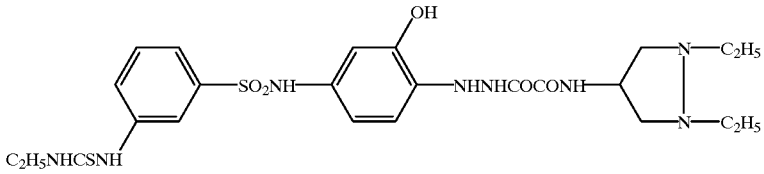

H-5

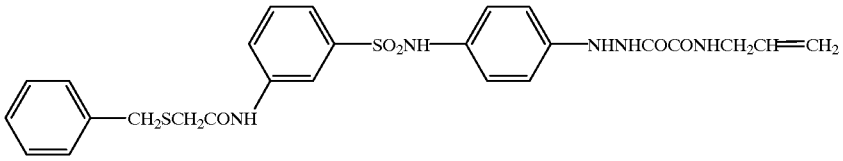

H-6

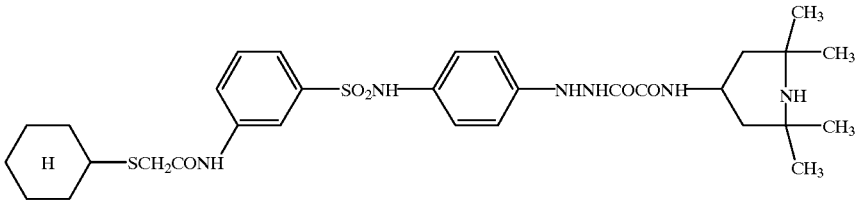

-continued
H-7
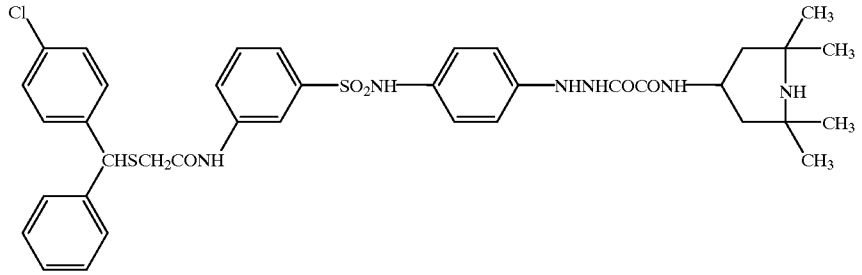
H-8
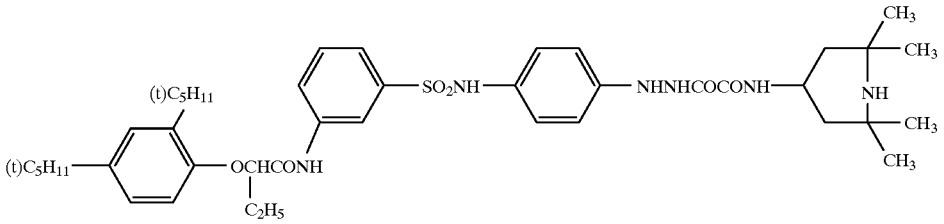
H-9
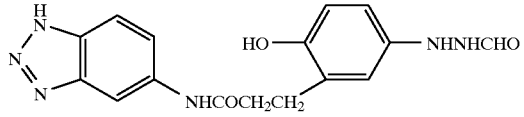
H-10
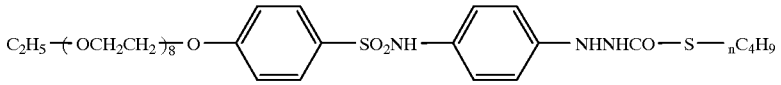
H-11
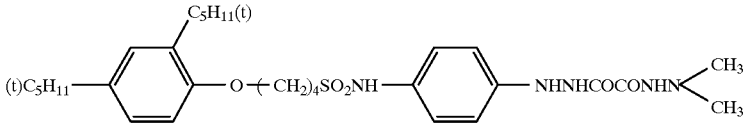
H-12
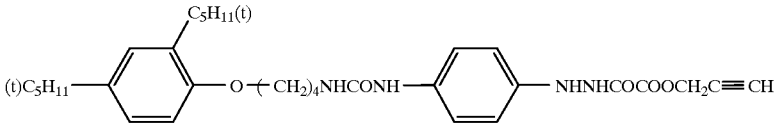
H-13
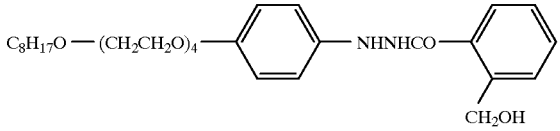
H-14
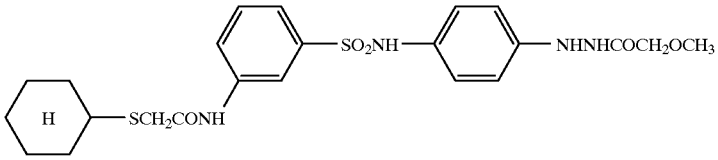

-continued
H-15
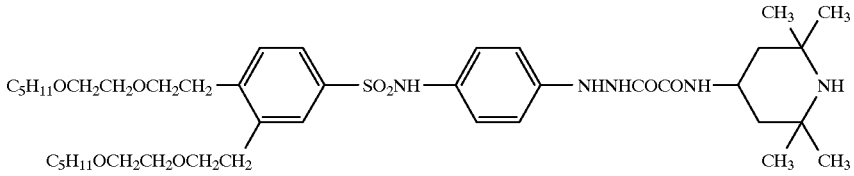
H-16
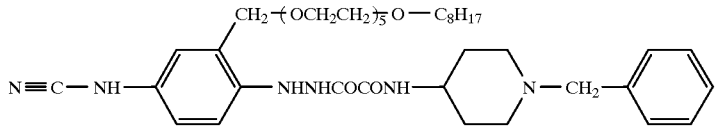
H-17
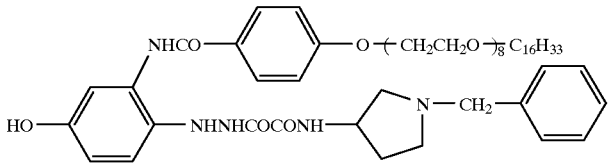
H-18
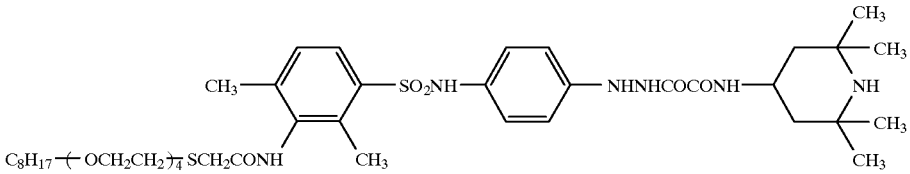
H-19
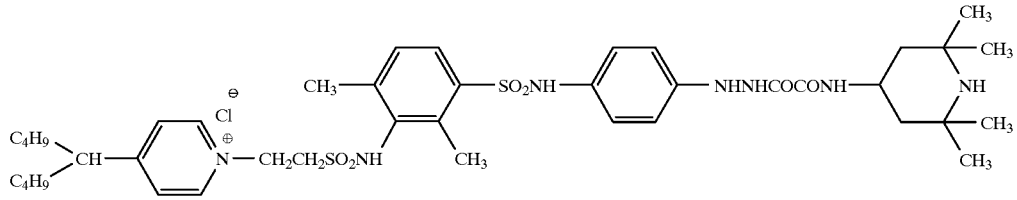
H-20
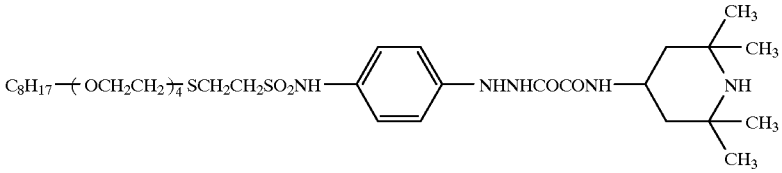
H-21
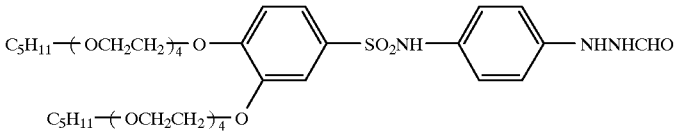
H-22
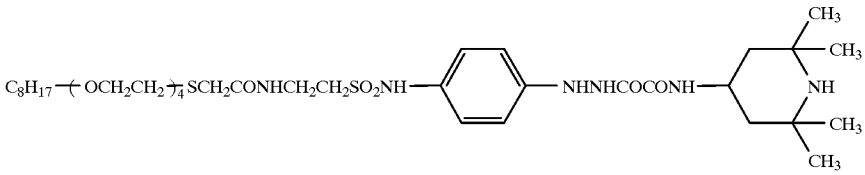

-continued

H-23

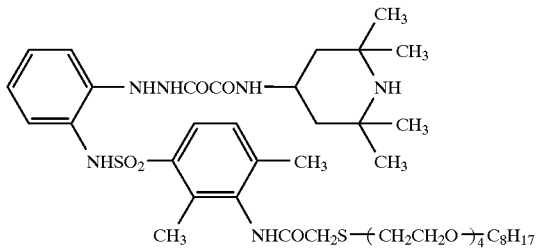

H-24

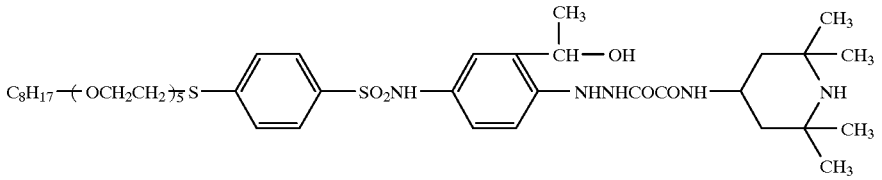

H-25

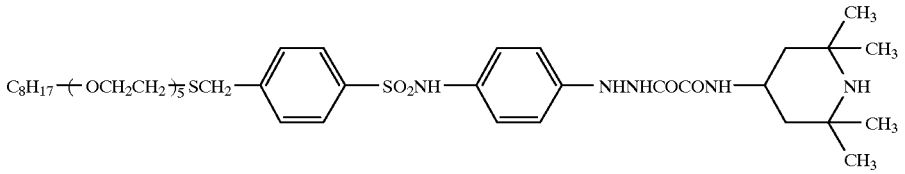

In addition, as examples of preferred hydrazine derivatives, for example,exemplified Compounds (1) through (252) disclosed on columns 59 through 80 of U.S. Pat. No. 5,229,248 can be mentioned.

The hydrazine derivatives used in the present invention can be synthesized according to the conventionally known methods in the art. For example, they may be synthesized according to the method disclosed on columns 59 through 80 in the U.S. Pat. No. 5,229,248.

The hydrazine derivative may be added in an amount capable of contrast-increasing the light-sensitive photographic material according to the present invention, and the optimum amount of addition may be varied depending on the size, halide composition, degree of chemical ripening of silver halide grains and kind of restraining agent used, however, it is generally between $10^{-6}$ and $10^{-1}$ mol, and, more preferably, between $10^{-5}$ and $10^{-2}$ mol per one mol of silver halide.

The hydrazine derivative used in the present invention is preferably incorporated either in the silver halide emulsion layer or a layer contiguous thereto.

In order to accelerate effectively the contrast-increase by the hydrazine derivative, it is preferable to use a nucleation accelerating compound represented by the following general formula (Na) or (Nb).

General Formula (Na)

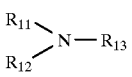

-continued

General Formula (Nb)

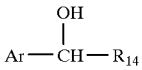

In the Formula (Na), R11, R12 and R13 independently represent a hydrogen atom, an alkyl group,a substituted alkyl group, an alkenyl group, a substituted alkenyl group,an alkenyl group, an aryl group or a substituted aryl group, provided that $R_{11}$, R12 and $R_{13}$ can combine with each other to form a ring. Among the compounds represented by formula (na) is preferable an aliphatic tertiary amine compound. It is preferable for these compounds to contain in their molecules a diffusion-proof group or a silver halide-adsorbing group. In order to be non-diffusible, the compound has preferably a molecular weight of 100 or more and, more preferably, not less than 300. As a preferable adsorbing group, for example, a heterocyclic group, a mercapto group, a thioether group, a thion group, thiourea group, etc. can be mentioned. As particularly preferable compound represented by the general formula (Na), a compound having in its molecule at least one thioether group as the silver halide adsorbing group can be mentioned.

Below, specific nucleation accelerating compounds represented by the General Formula (Na) are given.

Na-1

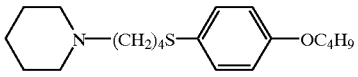

-continued

Na-2

$[(C_3H_7)_2N(CH_2)_3OCH_2CH_2]_2S$

Na-3

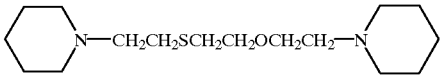

Na-4

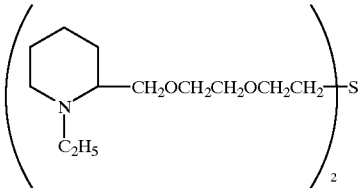

Na-5

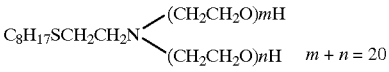

Na-6

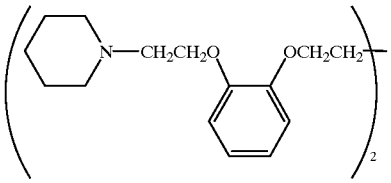

Na-7

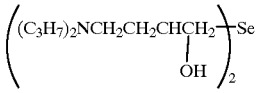

Na-8

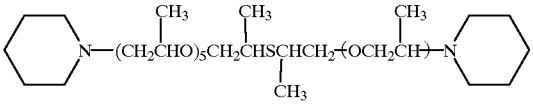

Na-9

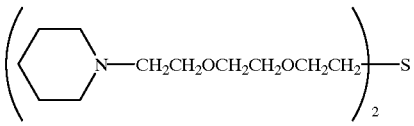

Na-10

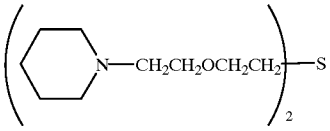

Na-11

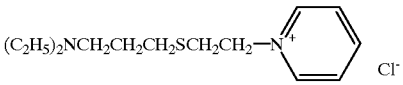

-continued

Na-12

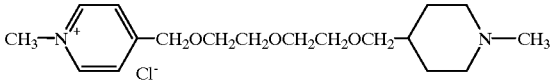

Na-13

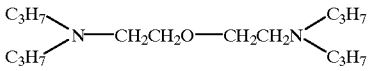

Na-14

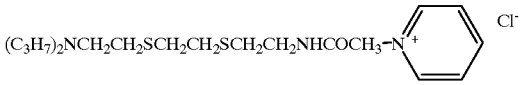

Na-15

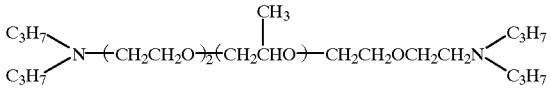

Na-16

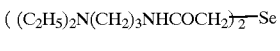

Na-17

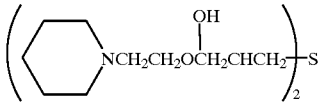

Na-18

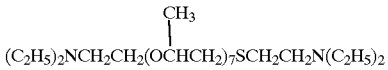

Na-19

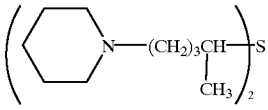

Na-20

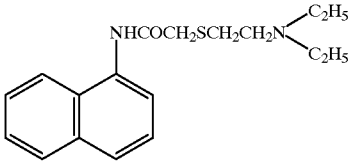

In the general Formula (Nb), Ar represents a substituted or unsubstituted aromatic hydrocarbon group or a heterocyclic group. $R_{14}$ represents a hydrogen atom, an alkyl group, an alkenyl group, an alkynyl group, or an aryl group, provided that Ar and $R_{14}$ may form a ring through a connecting group. The compound preferably contain in its molecule an diffusion-proof group or a silver halide-adsorbing group. The molecular weight to confer diffusion-proof property on the compound is 120 or more, and, more preferably, 300 or more. Further, as preferable silver halide-adsorbing group, the same group defined as the silver halide-adsorbing group in the General Formula (H) can be mentioned.

Specific exemplified compounds represented by the General Formula (Nb) are given below.

Nb-1
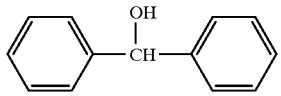
Nb-2
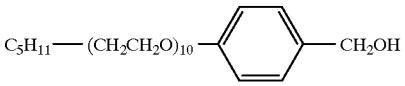
Nb-3
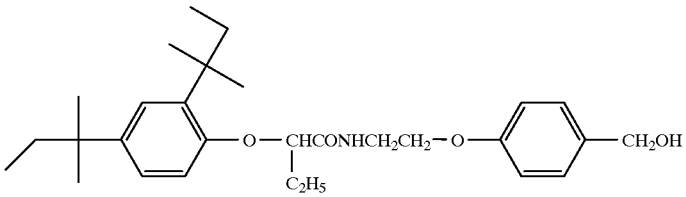
Nb-4
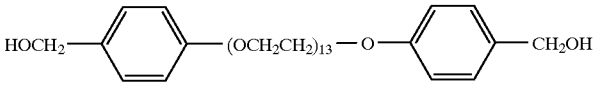
Nb-5
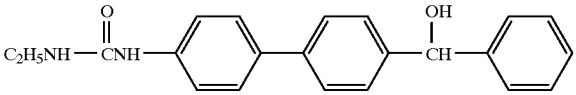
Nb-6
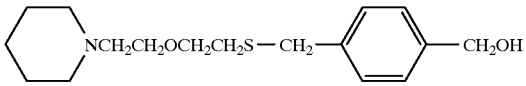
Nb-7
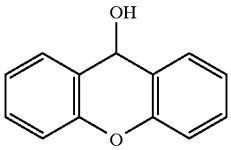
Nb-8
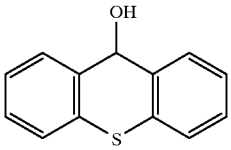
Nb-9
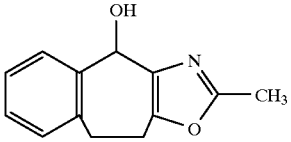

-continued

Nb-10

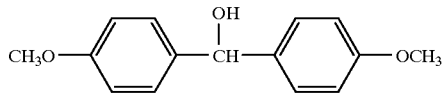

Nb-11

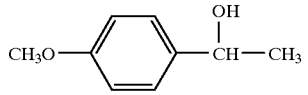

Nb-12

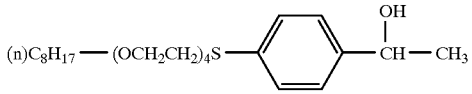

In addition, specific examples of the nucleation accelerating compounds include exemplified Compounds (2-1) through (2-20) disclosed in paragraphs (0062) on Page 13 through (0065) on page 15 in Japanese Patent OPI Publication No. 6-258751(1994) and exemplified Compounds 3-1 to 3-6 disclosed in paragraphs (0067) on page 15 through (0068) on page 16 in Japanese Patent OPI Publication No. 6-258751(1994).

The nucleation accelerating compounds may be used in any layer located on the side of the silver halide emulsion layer. Preferably the compounds are incorporated either in the silver halide emulsion layer or a layer adjacent thereto.

In the present invention, a silver halide emulsion layer or a hydrophilic colloidal layer may contain at least one compound represented by the General Formula (T) below.

Below, the compound represented by the general Formula (T) is explained.

General Formula (T)

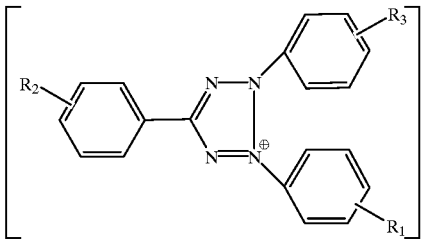

$$\left(\frac{1}{n_T}\cdot X_T^{n_T\ominus}\right)$$

Each oif $R_1$, $R_2$ and $R_3$ preferably represents a hydrogen atom or a group, of which Hammet's σ-value showing degree of electron attractiveness is in the negative.

The σ values of the phenyl substituents are disclosed in lots of reference books. For example, a report by C. Hansch in "The Journal of Medical Chemistry", vol. 20, on page 304(1977), etc. can be mentioned. Groups showing particularly preferable negative σ-values include, for example, methyl group ($\sigma_p$=−0.17, and in the following, values in the parentheses are in terms of $\sigma_p$ value), ethyl group(−0.15), cyclopropyl group(−0.21), n-propyl group(−0.13), iso-propyl group(−0.15), cyclobutyl group(−0.15), n-butyl group(−0.16), iso-butyl group(−0.20), n-pentyl group(−0.15), n-butyl group(−0.16), iso-butyl group(−0.20), n-pentyl group(−0.15), cyclohexyl group(−0.22), hydroxyl group(−0.37), amino group(−0.66), acetylamino group(−0.15), butoxy group(−0.32), pentoxy group(−0.34), etc. can be mentioned. All of these groups are useful as the substituent for the compound represented by the genwral formula T according to the present invention.

n represaents 1 or 2, and as anions represented by $X^{nT-}{}_T$ for example, halide ions such as chloride ion, bromide ion, iodide ion, etc.; acid radicals of inorganic acids such as nitric acid, sulfric acid, perchloric acid, etc.; acid radicals of organic acids such as sulfonic acid, carboxylic acid, etc.; anionic surface active agents, specifically including lower alkyl benzenesulfonic acid anions such asptoluenesulfonic anion,etc.; hyer alkylbenzene sulfonic acid anions such as p-dodecyl benzenesulfonic acid anion, etc.; hyer alkyl sulfate anions such as lauryl sulfate anion, etc.; Boric acid-type anions such as tetraphenyl borone, etc.; dialkylsulfo succinate anions such as di-2-ethylhexylsulfo succinate anion, etc.; polyetheralcioho; sulfate anions such as cetyl polyethenoxy sulfate anion,etc.; higher aliphatic acid anions such as stearic acid anion,etc.; and those in which an anionic radical is attached to a polymer,such as polyacrylic acid anion, etc. can be mentioned specific exemplified compounds represented by the general formula T are given, However, the scope of the present invention is not limited by these tetrazolium compounds.

| Compound | $R_1$ | $R_2$ | $R_3$ | $X_T^{nT-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | p-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OCH_3$ | H | p-$OC_2H_5$ | $Cl^-$ |
| T-13 | p-$OCH_3$ | H | p-iso$C_3H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |

-continued

| Compound | $R_1$ | $R_2$ | $R_3$ | $X_T^{nT-}$ |
|---|---|---|---|---|
| T-16 | H | p-$NH_2$ | H | $Cl^-$ |
| T-17 | p-$NH_3$ | H | H | $Cl^-$ |
| T-18 | p-$CH_3$ | H | p-$CH_3$ | $ClO_4^-$ |

The above-mentioned tetrazolium compounds can be synthesized according to the method described on pages 335 through 483, vol 55 of The Chemical Review.

There is no specific limitation as to halide composition in the silver halide emulsion used in the present invention. Preferably, however, silver chlorobromide or chlorobromoiodide containing 60 mol % or more chloride is used.

The average grain size of the silver halide is preferably 1.2 $\mu$m or less, and, more preferably 0.8 to 0.1 $\mu$m. The term "average grain size" has been used commonly in the art. The term "grain size" usually refers to a diameter of the grain, when the grain is of spherical shape or in the form close thereto. In the case when the grain is a cubic shape, it means a diameter of a sphere when the cube is converted into a sphere having the equivalent volume. With regard to the method of obtaining the average diameter, one can refer to the disclosure on pages 36–43, third edition of "The theory of the photographic process" edited by C. E. Mees and T. H. James and published by Mcmillan Co. in 1966.

There is no limitation as to the shape of the silver halide grain, and any one of tabular, cubic, spheric, tetradecahedral or octahedral shape can optionally be used. Concerning grain size distribution, the narrower, the more preferable. Particularly, so-called mono-dispersed emulsion,in which more than 90% of the total number of grains fall in the range ±40% around the average grain size, is preferable.

At the time of physical ripening or chemical ripening, metal salts of zinc, lead, thalium, iridium, rhodium, ruthenium, osmium, paradium, platinum, etc. can be coexisted. It is often commonly used to incorporate $10^{-8}$–$10^{-3}$ of iridium per mol silver halide for the purpose of improving high intensity reciprocity law failure characteristics. In the present invention, in order to obtain an emulsion with high contrast, it is preferable for $10^{-9}$ to $10^{-3}$mol of rhodium, ruthenium, osmium and/or rhenium per mol of silver halide to be incorporated in the solver halise emulsion.

It is preferable that rhodium, ruthenium, osmium and/or rhenium compound is added during the time of forming silver halide grains. Addition thereof may be optional, including a method of distributing uniformely inside the grain and a method of localizing in the core or shell portion of core/shell-structure grains.

Often, better results are obtained in the case when they are made present in the shell portion. Further, in the case when they are made present in a discrete layer structure, a method in which amount of presence is made greater depending on the distance from the center of the grain, may also be applied. Amount of addition may optionally be selected from the range between $10^{-9}$ and $10^{-3}$ mol per mol of silver halide.

Silver halide emulsions and preparation methods thereof are referred to Research Disclosure 17643 pages 22–23 (December 1973) and the references referred therein.

The silver halide emulsion used in the present invention may or may not be chemically sensitized. As method of chemical sensitization, sulfur sensitization, selenium sensitization, tellurium sensitization, reduction sensitization and noble metal sensitization have been well known in the art, and these methods may be used either singly or in combination. As a sulfur sensitizer, conventionally known sulfur sensitizers may be used. Preferable sulfur sensitizers include, besides sulfur compounds contained in gelatrin, various sulfur compounds, for example, thiosulfates, thio ureas, rhodnines, polysulfide compounds, etc. can be used. As selenium sensitizers, known seleniun sensitizers may be used. For example, those compounds disclosed in U.S. Pat. No. 1,623,499, Japanese Patent O.P.I. Publication Nos. 50-71325(1975) and 60-150046(1985) may preferably be used.

As tellurium sensitizers, known tellurium sensitizers can be used. For example, those compounds disclosed in U.S. Pat. No. 1,623,499. Japanese Patent O.P.I. Publication Nos. 50-71325(1975) and 60-150046(1985) can preferably be used.

Among noble metal sensitizations, gold sensitization is typical one, and gold compounds, mainly gold complexes are used. Other noble metal compounds, for example, complexes of platinum, paradium, rhodium, etc. may also be used.

As reduction senstizers, stannous salts, amines, formamidine sulfinic acids, silane compounds, etc. can be used.

The silver halide emulsion may be spectrally sensitized to an optional spectral wavelength with a a sensitizing dye. Useful sensitizing dye includes, for example, cyanine dyes, merocyanine dyes, complex cyanine dyes, complex merocyanine dyes, holopolar cyanine dyes, hemicyanine dyes, styryl dyes, and hemioxonol dyes. To these dyes, any nucleus applied to the cyanine dyes may be applied as a basic heterocyclic nucleus. That is to say, pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, etc.; and those nuclei fused with an alicyclic hydrocarbon ring or an aromatic hydrocarbon ring, i.e., indolenin nucleus, benzindolenin nucleus, indole nucleus, benzoxazole nucleus, naphthoxazole nucleus, benzthiazole nucleus, naphthothiazole nucleus, benzselenazole nucleus, benzimidazole nucleus, quiunoline nucleus, etc. may be applied. These nuclei may be substituted on a carbon atom thereof. To merocyanine dyes or complex merocyanine dyes, as a nucleus having a ketomethylene structure, five-membered or six-membered heterocycle, such as thiohydantoin nucleus, 2-thiooxazolidine-2,4-di-one nucleus, rhodanin nucleus, thiobarbituric acid nucleus, etc. can be applied. More specifically, those compounds disclosed in Research Disclosure (RD) No. 17643, on pages 2 and 3 (December 1978), U.S. Pat. Nos. 4,425,425, 4,425,426 can be used. The sensitizing dye may be dissolved by means of ultrasonic dispersion disclosed in U.S. Pat. No. 3,485,634. As other methods for dissolving or incorporating the sensitizing dye used in the present invention in the emulsion, those methods disclosed in U.S. Pat. Nos. 3,482,981, 3,585,195, 3,469,987, 3,425,835, 3,342,605; British Patent Nos. 1,271,329, 1,038,029, 1,121,174; U.S. Pat. Nos. 3,660,101 and 3,658,634 can be used. These sensitizing dyes may be used either singly or in combination. Combined use of the sensitizing dyes are often employed for the purpose of super-sensitization. Useful combinations of the sensitizing dyes exhibiting super-sensitization are disclosed in Research Disclosure (RD) No. 17643 (December 1978), on page 23 IV-J.

When the present invention is applied to light-sensitive materials for printing plate-making, desensitizing dyes may be used in order to control sensitivity and adaptability to safe light. It is particularly useful to use the desensitizing dye for preparation of roomlight handling light-sensitive materials. Below, specific organic desensitizers usable in the present invention are given.

| | |
|---|---|
| (DS-1) | Pheno safranin |
| (DS-2) | Pinacryptol green |
| (DS-3) | 2,3-Dimethyl-6-nitro-benzthiazolium p-toluene sulfonate |
| (DS-4) | 2-(p-nitrostyryl)quinoline p-toluene sulfonate |
| (DS-5) | 1,3-Diethyl-1'-methyl-2'-phenylimidazo-[4,5-b]quinoxaline-3'-indocarbocyanine iodide |
| (DS-6) | Pinacryptol yellow |
| (DS-7) | 1,1,3,3'-Hexamethyl-5,5'-dinitroindo-carbocyanine p-toluene sulfonate |
| (DS-8) | 5,5'-Dichloro-3,3'-diethyl-6,6'-dinitro-carbocyanine iodide |
| (DS-9) | 1,1'-Dimethyl-2,2'-diphenyl-3,3'-indoro-carbocyanine.bromide |
| (DS-10) | 1,1',3,3'-Tetramethylimidazo[4,5-b]quino-oxalinocarbocyaninechloride |
| (DS-11) | 5-m-Nitrobenziridene rhodanin |
| (DS-12) | 6-Chloro-4-nitrobenztriazole |
| (DS-13) | 1,1'-Dibutyl-4,4'-bipyridinium dibromide |
| (DS-14) | 1,1,-Ethylene-2,2'-bipyridinium dibromide |
| (DS-15) | 2-Mercapto-4-methyl-5-nitrothiazole |
| (DS-16) | 2-(O-Nitrostiryl)-3-ethylthiazolium p-toluene sulfonate |
| (DS-17) | 2-(p-Nitrostyryl)quinoline p-toluene sulfonate |

The amount of use of the above-mentioned desensitizing agent is usually between 10–5 g per 1 mol of silver halide, and, more preferably, 50–3 g. It may be incorporated in the form of an aqueous solution or a solution of an organic solvent. Further it may also be incorporated in the form of a dipersion of solid fine particles prepared by mean of a sand mill, a ballmill or imperer dispersion. The particle sizes is usually appropriate wothin a range of 0.001 to 20 μm. Particularly preferable size is 0.01–1 μm. The organic desensitizing agent is often characterized in terms of polarographic half-wave potential. That is to say, the sum of anodic potential and cathodic potential in the polarograph is positive. Thef measurement thereof is disclosed in the U.S. Pat. No. 3,501,307.

In the light-sensitive material according to the present invention can comprise a variety of compounds for the purpose of preventing fog during manufacture, storage or photographic processing of the light-sensitive material. Those compounds include compounds which are known as stabilizers or anti-foggants in the art. For example, azoles such as benzthiazolium salts, nitroindazoles, chlorobenzimidazoles, bromobenzimidazoles, mercaptothiazoles, mercaptobenzthiazoles, mercaptobenzimidazoles, mercaptobenzthiadiazoles, aminotriazoles, benztriazoles, nitrobenztriazoles, mercaptotetrazoles, such as 1-phenyl-5-mercaptotetrazole, etc.; mercaptopyrimidines, mercaptotriadines, thioketo compounds such as oxazolinthione; azaindenes such as triazaindenes, tetrazaindenes including 4-hydroxy-substituted 1,3,3a,7-tetrazaindenes, pentazaindenes, etc, benzenethiosulfonic acid, benzenesulfinic acid, benzenesulfonic acid amide, etc. can be mentioned.

As binder or a protective colloid of the photographic emulsion used in the present invention, gelatin is advantageously used, however, other hydrophilic colloids may also be used. The hydrophilic colloids include, for example, gelatin derivatives, graft polymers comprised of gelatin and other polymers; proteins such as casein, albumin, etc.; cellulose derivatives such as hydroxyethyl cellulose, carboxymethyl cellulose, cellulose sulfates, etc.; sugar derivatives such as sodium alginate, starch derivatives, etc.; synthetic hydrophilic polymers such as polyvinyl alcohol and partial acetal thereof, poly-N-pyrrolidone, polyacrylic acid, polymethacrylic acid, polyacrylamide, polyvinyl imidazole, polyvinyl pyrazole,etc. These polymers may be either homopolymers or copolymers.

As gelatin, there may be usable an acid process gelatin as well as lime-processed gelatin. Further, hgydrolytic products or enzyme decomposition products of gelatin may also be used.

In the photographic emulsion according to the present invention, for the purpose of improving dimensional stability, etc., sytnthetic polymers which are water-insoluble, or sparingly water-soluble can be incorporated. For example, alkyl(metha)acrylates, alkoxy(metha)acrylates, glycidyl(metha)acrylates, (metha)acrylamides, vinyl esters such as vinyl acetate, acrylonitrile, styrene, etc. may be used either singly or in combination. Further, these polymers may be used in the form of a copolymer together with other monomer constituents such as acrylic acid, methacrylic acid, α,β-unsaturated dicarboxylic acid, hydroxylalkyl(metha) acrylate, sulfoalkyl(metha)acrylate, styrene sulfonic acid, etc.

As to other conventional additives, compounds disclosed in Research Disclosure Nos. 17643 (December 1978), 18716 (November 1979) and 30811 (December 1989) can be mentioned. Below, compounds discliosed in these three references and locations thereof are given.

| | [RD-17643] | | | [RD-308119] | |
|---|---|---|---|---|---|
| | Page | Cate-gory | [RD-18716] Page | Page | Cate-gory |
| Chemical sensitizer | 23 | III | 648 upper right | 996 | III |
| Sensitizing dye | 23 | IV | 648–649 | 996–998 | IV |
| Desensitizing dye | 23 | IV | | 998 | IV |
| Dye | 25–26 | VIII | 649–650 | 1003 | VIII |
| Development accelerator | 29 | XXI | 648 upper right | | |
| Anti-foggant, Development inhibitor | 24 | IV | 649 upper right | 1006–1007 | VI |
| Brightening agent | 24 | V | | 998 | V |
| Hardener | 26 | X | 651 left | 1004–1005 | X |
| Surfactant | 26–27 | XI | 650 right | 1005–1006 | XI |
| Anti-static agent | 27 | XII | 650 right | 1006–1007 | XIII |
| Plasticizer | 27 | XII | 650 right | 1006 | XII |
| Lubricant | 27 | XII | | | |
| Matting agent | 28 | XVI | 650 right | 1008–1009 | XVI |
| Binder | 26 | XXII | | 1003–1004 | IX |
| Support | 28 | XVII | | 1009 | XVII |

These various types of photographic additives used in the present invention may be incorporated in the light-sensitive material according to the present invention in the form of an aqueous solution or a solution of an organic solvent. When the additive is hardly soluble in water, it may also be incorporated in the form of a dispersion of fine crystalline particles dispersed in water, gelatin,or hydrophilic or hydrophobic polymer. In order to disperse the above-mentioned dye, colorlant, desensitizing dye, hydrazine, a redox compound, anti-foggant, ultraviolet-ray absorbent, etc., any conventionally used dispersing machine can be used. Specifically, a ball-mill, a sand-mill, a colloid mill, ultrasonic distributor or an high-speed impeller can be mentioned. These photographic additives dispersion is comprised of fine particles with the average particle size of less than 100 μm, preferably, 0.02 and 10 μm. Methos of dispersion include, for example, a method of mechanically stirring at a high speed (Japanese Patent O.P.I. Publication No. 44-22948; a method, in which an additive is dissolved, with heating, in an organic solvent, and, then dispersed, while adding gelatin or a hydrophilic polymer containing a surface active agent or a an deforming agent and removing the organic solvent (Japanese Patent O.P.I. Publication No. 44-22948(1969)); a method in which an additive is dissolved in citric acid, acetic acid, sulfric acid, hydrochloric acid or malic acid and dispersed in a polymer with the pH of 4.5 to 7.5 to form precipitates;and a method in which an additive is dissolved in an alkali solution such as sodium hydroxide, sodium hydrogen carbonate, sodium carbonate,etc. and dispersed in a hydrophilic binder such as gelatin with the pH of 4.5 to 7.5 to form precipitates (Japanese Patent O.P.I. Publication No. 2-15252(1990)), etc. can be applied. For example, hydrazine, which is sparingly soluble in water may be dissolved with reference to the method disclosed in Japanese Patent O.P.I. Publication No. 2-3033(1990), and this method may be applied to other additives having the similar nature. Similarly, the fixing rates of dyes,sensitizing dyes, restraining agents, etc. having a carboxylic group in the molecule can be elevated by making use of chelating ability of the carboxylic group. That is to say, it is preferable to make them hardly soluble salts by adding 200 to 4,000 ppm of calcium ion, magnesium ion, etc. to the hydrophilic colloidal layer. Once a hardly-soluble salt is formed, use of other salts are not restricted. The method of incorporation of photographic additives in the form of a dispersion of solid fine particles into the light-sensitive photographic material according to the present invention can optionally be applied depending on the chemical and physical properties to other photographic additives such as sensitizers, dyes restrainers, accelerators, hardening agents, hardening aids, etc.

In the present invention, in order to simultaneously coat a plurality of constituent layers of two to ten, slide-hopper coating method or the curtain coating method disclosed in U.S. Pat. Nos. 3,663,374 and 3,508,947 can be used. To make improvement in uneven coating, it is effective to lower the surface tension of a coating solution or to use the above-mentioned hydrophilic polymers capable of providing thixotropic property in which lowering in viscosity is caused by shearing force.

In the light-sensitive photographic material according to the present invention, a crossover light-cutting layer, an anti-static layer, an anti-halation layer and a backing layer may also be provided.

As a method of packaging light-sensitive photographic materials according to the present invention, any method known in the art may be applied.

Since silver halide light-sensitive photographic materials are vulnerable to heat and moisture, it is preferable to avoid storage under severe conditions. Generally, it is preferable to keep them under temperature condition between 5° C. and 30° C. Concerning moisture, the relative humidity is preferably 35 to 60%. For the purpose of protecting from humidity, they are generally wrapped with 1–2,000-$\mu$m-thick polyethylene. Permeation of moisture can be restricted by enhancing the crystallinity of polyethylene by the use of a metallocene catalyst. Permeation of moisture may also be restricted by coating the surface of polyethylene with 0,1 to 1,000-$\mu$m-thick silica by evaporation.

To a developing solution may optionally be added various additives including, for example, an alkali agents such as sodium hydroxide, potassium hydroxide,etc,; pH buffers such as carbonates, phosphates, borates, boric acid acetic acid, citric acid, alkanolamine, etc,; solubilization aids such as polyethylene glycols, esters thereof, alkanolamine, etc.; sensitizers such as nonionic surface active agents containing a polyoxyethylene, quarternary ammonium compounds, etc.; surface active agents, antifoaming agents, anti-foggants such as halide compounds such as potassium bromide, sodium bromide, etc.; nitrobenzindazole, nitrobenzimidazole, benztriazole, benzthiazole, tetrazole compounds, thiazole compounds, etc.; chelating agents such as ethylenediaminetetraacetic acid or alkali salts thereof, nitrilotriacetic acid, polyphosphonic acids, etc.; development accelerators such as those compounds disclosed in the U.S. Pat. No. 2,304,025, Japanese Patent Publication No.47-45541(1972), etc,; hardening agents such as glutal aldehyde or metasulfite additives thereof, etc.; anti-foaming agents, etc. may the pH of the developing solution is preferably adjusted not less than 7.5 and less than 10.5. More preferably the pH is adjusted not less than 8.5 and less than 10.4.

Waste developer solution may be regenerated by electric energization. Specifically, an anode, for example, an electric conductor such as stainless wool, or a semi-conductor is put in the waste developing solution, and a cathode, for example, an insoluble conductor such as carbon, gold, platinum, titanium, etc. is put in an electrolyte solution, and the waste developer bath and the electrolyte bath are brought into contact through an anion exchange membrane, and electricity is applied to both electrodes to undergo regeneration. It is also possible to process the light-sensitive material according to the present invention while applying electricity to the both electrodes. Upon this, various additives which can be added to the developing solution, including, for example, preserving agents, alkali agents, pH buffers, sensitizers, anti-foggant, silver sludge restrainers, etc. may be incorporated. There has been known a method of processing light-sensitive materials while applying electricity to the developing solution, and upon such a process the additives which can be added to the developer as mentioned above, may further be incorporated. When the waste developing solution is reused after regeneration treatment, it is preferable for a transition metal complex-type compound to be employed as a developing agent.

As one mode of development, the developing agent may be incorporated in the light-sensitive material, for example in an emulsion layer or a layer adjacent thereto, and developing process is carried out in an alkaline solution, which is so-called an activator processing solution. Further, a light-sensitive material comprising a developing agent in a silver halide emulsion layer or a layer adjacent thereto may be processed with a developing solution. This kind of developing process is often employed as a rapid processing method in combination with silver salt stabilization process using a thiocyanate, and the present invention may also be applicable to such a processing solution.

As a fixing solution, any one which are popularly known in the art can be used. The fixing solution is an aqueous solution containing a fixing agent and other additives, and the pH of the fixing solution is usually between 3.8 and 5.8. As the fixing agent, for example, thiocyanates such as sodium thiosulfate, potassium thiosulfate, ammonium thiosulfate, sodium thiocyanate, potassium thiocyanate, ammonium thiocyanate and other organic sulfur compounds which are capable of producing a stable silver complex salts and are known in the art as a fixing agent can be used.

Into the fixing solution, a compound which functions as a hardening agent, including, for example, water-soluble aluminium salts such as aluminium chloride, aluminium sulfate, potassium alum, aldehyde compounds (such as glutal aldehyde or its sulfite adduct, etc.) may be added.

The fixing solution may contain, if necessary, preservatives such as sulfites or metasulfites; pH buffers such as acetic acid, citric acid, etc.; pH adjuster such as sulfuric acid, or chelating agents capable of softening hard water, etc. It is preferable that the concentration of ammonium ion in the fixing solution is 0.1 mol or less per liter of the fixing solution. Particularly preferable concentration of the ammonium ion in the fixing solution is between 0 and 0.5 mol per liter of fixing solution. As the fixing agent, sodium thiosulfate may be used instead of ammonium thiosulfate. They can also be used in combination. It is preferable that concentration of acetate ion is less than 0.33/liter. There may be applicable any compounds capable of releasing an acetate ion in the fixing solution. Acetic acid or a lithium, potassium, sodium or ammonium salt thereof are preferable. Particularly preferable are sodium salt and ammonium salt. The concentration of the acetate ion is preferably 0.22 mol or less, and more preferably, 0.13 mol or less per liter of the fixing solution.

Under this condition generation of acetic acid gas can be highly restrained. Most advantageously, the fixing solution does not substantially contain any acetate ion at all.

It is preferable that the fixing solution contains a thiosulfate. As thiosulfates, for example, lithium salt, potassium salt, sodium salt, ammonium salt, etc. can be mentioned and, preferably, they are sodium salts or ammonium salts. Amount of addition of the thiosulfate is generally between 0.1 and 5 mols, preferably between 0.5 and 2.0 mols, more preferably between 0.7 and 1.8 mols and, most preferably, between 0.8 and 1.5 mols per liter of the fixing solution.

The fixing agent contains a salt of citric acid, tartaric acid, malic acid, succinic acid or an optical isomer thereof. As the salt of the citric acid, tartaric acid, malic acid or succinic acid, lithium salt, potassium salt, sodium salt, ammonium salt, etc. can be mentioned. Further, lithium hydrogen salt, potassium hydrogen salt, sodium hydrogen salt, or ammonium hydrogen salt of the tartaric acid; ammonium potassium tartarate; or sodium potassium tartarate, etc. may also be used. Among these, are preferable citric acid, isocitric acid, malic acid and succinic acid and the salts thereof; and the most preferable compound is malic acid or salts thereof.

The silver halide light-sensitive photographic material according to the present is usually subjected to process in a washing(or rinsing) bath or in a stabilizing bath. The stabilizing solution usually contains, for the purpose of stabilizing an produced image, an inorganic or organic acid or salt thereof for adjusting pH of the membrane (at pH 3–8 after processing), or an alkaline agent or a salt thereof, including, for example, boric acid, metaboric acid, borax, phosphates, carbonates, potassium hydroxide, sodium hydrioxide, ammonia water, mono-carboxylic acids, dicarboxylic acids polycarboxylic acids, citric acid, oxalic acid, malic acid acetic acid, etc.; aldehydes such as formalin, glyoxal, glutalalhehyde, etc.; chelating agents such as ethylenediamintetraacetic acid, or an alkali metal salt thereof, nitrilotriacetic acid, polyphosphates, etc.; antimolds such as phenol, 4-cylorophenol, cresol, o-phenylphenol, chlorophenol, dichlorophenol, formaldehyde, p-hydroxybenzoate, 2-(4-thiazoline)-benzimidazole, benzisothiazolin-3-one, dodecylbenzyl-methylammonium chloride, N-(fluorodichloromethylthio)-phthalimide, 2,4,4'-trichloro-2'-hydroxydiphenyl ether, etc,; toning agents and/or residual color-improving agents such as nitrogen-containing heterocyclic compuonds, including, for example, 2-mercaopto-5-sodiumsulfonate-benzimidazole, 1-phenyl-5-mercapto tetrazole, 2-mercaptobenzothiazole, 2-mercapto-5-propyl-1, 3,4-triazole, 2-mercaptohypoxanthine, etc. Scecifically, it is preferable that the stabilizing solution contains an antimold. These compounds may be replenished either in the form of a liquid or a solid. When an additive is replenished in the form of solid, the methods of manufacturing and using as afore-mentioned may be used.

In view of a demand for decresing the amount of waste liquids, the light-sensitive materials are often processed while being replenished with a given amount of developing solution in proportion to the processed area of the light-sensitive material. Suitable replenishing amount of the developing solution and the fixing solution is 330 ml or less per square meter of the light-sensitive material, respectively. More preferably, it is between 300~200 ml, respectively. Herein the terms "replenishing amount of the developing solution" and "replenishing amount of the fixing solution" respectively denote the amount of the solution to be replenished.

Temperatures of the developing, fixing, washing and/or stabilizing solutions are preferably between 10 and 45° C., and they may be controlled separately.

In light of a demand for shortening the overall processing time, it is preferable that the overall processing time (Dry-to-Dry) from the time when the front end of a film is put into the automatic processing machine to the time when it comes out of the drying zone is between 10 to 50 seconds.

In the present invention, it is characterized that the temperature of the drying section of the automatic processing machine is 60° C. or lower. When the temperature of the drying section is higher than 60° C., the support may be deformed, or silver images may be destroyed due to heat, which adversely affect the tone reproduction. Accordingly, the temperature of an electric heating member or a duplication product may be higher than 60° C., but it is not advantageous for the surface temperature of the light-sensitive material to become higher than 60° C.

In the present invention, a heat conductive member (e.g., a heat roller heated at 60 to 150° C.) or a radiation body (by directly applying electricity to a tungsten, carbon, Nicrome, a mixture of zirconium oxide, yttrium oxide or thorium oxide to heat and emit radiation, or by conducting thermal energy from a resistance pyrogeneous substance to a radiation emissive substance such as copper,stainless, nickel and various types of ceramics to generate heat or radiative infrared rays) can preferably be used to construct the heating zone.

As the heat conductive substance of 60° C. or lower, a heat roller can be mentioned as an example, The heat roller is preferably made of hollow aluminum cylinder and the peripheral surface thereof is coated with a resin such as silicon rubber, polyurethane or Teflon. Both end portions of this heat roller is preferably arranged inside the drying section in the vicinity of the in-let transport mouth of the processor with shaft bearings made of a heat resistant resin such as "Luron" (trade name) and rotationally supported against side walls of the section.

Further, it is preferable that one end portion of the heat roller is fixed with a gear, and is rotated in the direction of transport. Inside the roller of the heat roller, a halogen heater has been inserted, and the halogen heater is preferably connected to a heat regulator arranged in the automatic processing machine.

A thermister, which is arranged in contact with the peripheral surface of the heat roller, is connected to the heat regulator, and the heat regulator has preferably been set up so as to change the switch of the halogen heater, when detected temperature by the thermister is between 60 and 150° C. and more preferably, between 70 and 130° C.

As examples of substances capable of emitting radiations with temperature higher than 150° C. (more preferably, higher than 250° C.), the following substances can be mentioned: tungsten, carbon, tantalum, Nichrome, a mixture of zirconium oxide, yttrium oxide and thorium oxide, carbon silicate, molybdenum disilicate. Further, methods of directly applying electricity to a radiating element such as tungsten, carbon, Nicrome, a mixture of zirconium oxide, yttrium oxide and thorium oxide to heat and emit radiation, or conducting thermal energy from a resistance pyrogeneous substance to a radiation emissive substance such as copper, stainless steel, nickel and various types of ceramics, to generate heat or radiate infrared rays may also be used.

EXAMPLE

Below, the present invention is further explained with reference to working examples, however, the scope of the present invention is not limited by these examples.

Example 1

Measurement of sliding friction of the guide conditions for measurement 0.2 ml of water was dropped on a test sample having an area of 200 $mm^2$, and the sample was placed on a polyethylene terephthalate film (PET 100E) so that the wetted side of the sample was brought into contact with the film. Further thereon was loaded a weight of 300 g and then the sample was pulled at a constant speed by applying a force (F) thereto, in the direction parallel to the slip plane of the sample. The sliding friction was defined as the force (F).

Sliding frictions of a variety of guide materials were shown in FIG. 1. As obvious from FIG. 1, the sliding friction varies remarkably depending upon the kind of the guide material.

FIG. 1, the numbers referring to the guide materials are denoted as follows:

(1) Stainless flat plate, (2) Stainless corrugated plate, (3) Fluorine-coated stainless flat plate, (4) Fluorine-coated corrugated plate, (5) Polycarbonate resin (PC), (6) Acrylonitrile/Butadiene/Styrene copolymer resin (ABS), (7) Nylon, (8) Acrylonirile/Styrene copolymer resin (AS), (9) Stainless ripple plate (Rpl).

Example 2

Preparation of samples containing a compound represented by the formula (H)

First emulsion layer

Into an aqueous gelatin solution maintained at 40° C. and containing $5\times10^{-3}$ mol per 1 mol of silver of 4-hydroxy-6-methyl-1,3,3a,7-tetrazaindene(TAI), an aqueous silver nitrate solution and an aqueous sodium chloride solution containing $2\times10^{-5}$ mol per 1 mol of silver of $(NH_4)Rh(H_2O)Cl_5$ were added simultaneously over a period of 7 minutes, while controlling the silver potential of the emulsion at 95 mV, to form core grains with an average size of 0.12 $\mu$m. Then, an aqueous silver nitrate solution and an aqueous sodium chloride solution containing $(NH_4)Rh(H_2O)Cl_5$ of $1.2\times10^{-4}$ mol per 1 mol of silver were added simultaneously over a period of 14 minutes, while controlling the silver potential at 95 mV, to prepare cubic-shaped silver chloride grains having an average size of 0.15 $\mu$m. The resulting emulsion was chemically sensitized according to the conventional method. To the emulsion were further added polyethylacrylate latex (average particle size of 0.05 $\mu$m) of 600 $mg/m^2$, a hydrazine compound H-6 of $2.2\times10^{-5}$ $mol/m^2$, TAI of 30 $mg/m^2$, and Compounds 16 and 17 of 40 $mg/m^2$ and 10 $mg/m^2$. As a hardener, Compound 18 was further added in an amount so as to give the water content as shown in Table 1, to prepare an emulsion coating solution. The coating solution was coated on a support so as to have a silver coverage of 2.0 $g/m^2$ and gelatin amount of 0.6 $g/m^2$.

Second emulsion layer

Into an aqueous gelatin solution maintained at 40° C. and containing $5\times10^{-3}$ mol per 1 mol of silver of 4-hydroxy-6-methyl-1,3,3a,7-tetrazaindene(TAI), an aqueous silver nitrate solution and an aqueous sodium chloride solution containing $4\times10^{-5}$ mol per 1 mol of silver of $(NH_4)Rh(H_2O)Cl_5$ were added simultaneously over a period of 3 minutes and a half, while controlling the silver potential of the emulsion at 95 mV, to form core grains with an average size of 0.08 $\mu$m. Then, an aqueous silver nitrate solution and an aqueous sodium chloride solution containing $(NH_4)Rh(H_2O)Cl_5$ of $1.2\times10^{-4}$ mol per 1 mol of silver were added simultaneously over a period of 14 minutes, while controlling the silver potential at 95 mV, to prepare cubic-shaped silver chloride grains having an average size of 0.10 $\mu$m.

The second emulsion layer was coated so as to have a silver coverage and gelatin of 1.5 and 0.5 $g/m^2$, respectively, in the same manner, except that silver halide emulsion was replaced by the above emulsion.

| | |
|---|---|
| Lower protective layer: | |
| Gelatin | 0.5 $g/m^2$ |
| 1-hydroxy-2-benzaldoxim | 15 $mg/m^2$ |
| Compound-19 | 80 $mg/m^2$ |
| Compound-20 | 10 $mg/m^2$ |
| Polyethylacrylate latex (average diameter: 0.05 $\mu$m) | 280 $mg/m^2$ |
| Upper protective layer: | |
| Gelatin | 0.4 $g/m^2$ |
| Amorphous matting agent (SiO2; average diameter: 3.0 $\mu$m) | 30 $mg/m^2$ |
| Amorphous matting agent (PNMA; average diameter: 2.7 $\mu$m) | 30 $mg/m^2$ |
| Liquid paraffin (gelatin dispersion) | 50 $mg/m^2$ |
| Potassium N-perfluorooctanesulfonyl-N-propylglycinate | 5 $mg/m^2$ |
| Sodium dodecylbenzene sulfonate | 10 $mg/m^2$ |
| Dye A (solid particle dispersion) | 80 $mg/m^2$ |
| Dye B (solid particle dispersion) | 40 $mg/m^2$ |

Preparation of fine particle dispersions of Dyes A and B

Water(434 ml) and 6.7% solution of TritonX-200R surfactant, sold by TX-200R Rohm & Haas Co. were added into a 1.5-liter-bottle with a screw cap. Further, 20 g of dye and 800 ml of zirconium oxide beads with a diameter of 2 mm were added thereto, then, the cap was closed firmly, and it was placed inside a mill to pulverize for four days. Then, the content was added to 12.5% aqueous gelatin solution (160 g), and placed in a roll-mill for ten minutes, to reduce foaming. The thus obtained mixture was filtered to remove zirconium oxide beads. At this stage since the average diameter was 0.3 $\mu$m and coarse particles are still contained, this was thereafter subjected to centrifuge pulverization, to make the size of the largest particle contained to be 1 $\mu$m or less.

Next, an conductive layer and a backing layer, of which compositions are given below, were coated simultaneously on the opposite side of the support.

| | |
|---|---|
| Conductive layer | |
| $SnO_2$/Sb (9/1 by weight, average particle size: 0.25 μm) | 200 mg/m$^2$ |
| Gelatin (Ca-content: 3,000 ppm) | 77 mg/m$^2$ |
| Compound-21 | 7 mg/m$^2$ |
| Sodium dodecylbenzene sulfonate | 10 mg/m$^2$ |
| Dihexyl-d-sulfosuccinate | 40 mg/m$^2$ |
| Sodium polystyrene sulfonate | 9 mg/m$^2$ |
| Backing layer | |
| Gelatin (Ca-content: 30 ppm) | 2 g/m$^2$ |
| Polymethyl methacrylate fine particles (average diameter: 4.7 μm) | 54 mg/m$^2$ |
| Compound-21 | 3 mg/m$^2$ |
| Compound-22 | 40 mg/m$^2$ |
| Compound-23 | 40 mg/m$^2$ |
| Compound-24 | 80 mg/m$^2$ |
| Compound-25 | 150 mg/m$^2$ |
| Sodium dodecylbenzene sulfonate | 75 mg/m$^2$ |
| Dihexyl-d-sulfosuccinate | 20 mg/m$^2$ |
| Compound-26 | 5 mg/m$^2$ |
| Sodium sulfate | 50 mg/m$^2$ |

Compound-16

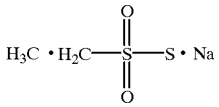

Compound-17

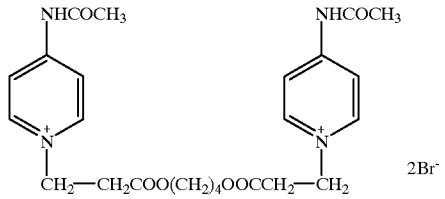

Compound-18
$CH_{2=CHSO2}CH_2SO_2CH{=}CH_2$
Compound-19

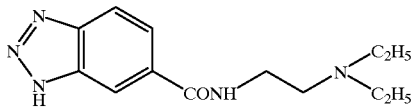

Compound-20

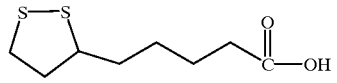

Solid Dispersion Dye A

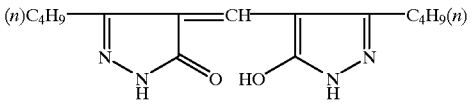

-continued

Solid Dispersion Dye B

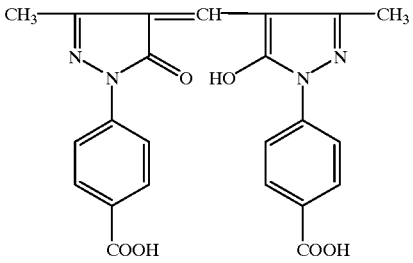

Compound 21

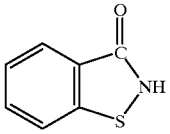

Compound 22

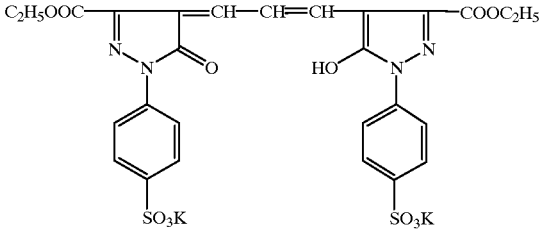

Compound 23

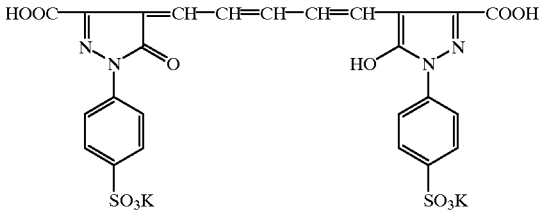

Compound 24

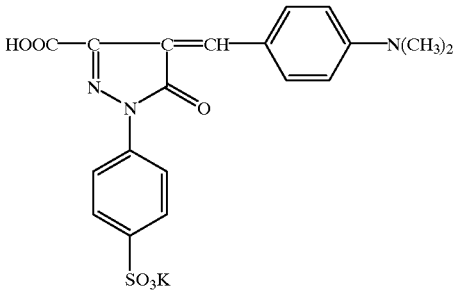

-continued

Compound 25

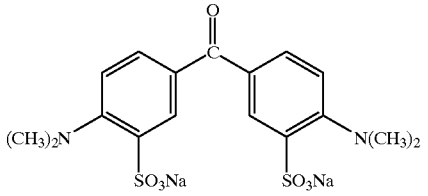

Compound 26
$C_8F_{17}SO_3Li$

| Composition of Developing Solution (per 1 liter) | |
|---|---|
| Penta sodium diethylenetriaminepenta acetate | 1.0 g |
| Sodium sulfite | 42.5 g |
| Potassium sulfite | 17.5 g |
| Potassium carbonate | 55.0 g |
| Hydroquinone | 20.0 g |
| 1-Phenyl-5-mercapto tetrazole | 0.03 g |
| 4-Methyl-4-hydroxymethyl-1-phenyl-3-pyrazolidone | 0.85 g |
| Potassium bromide | 4.0 g |
| Benzotriazole | 0.21 g |
| Boric acid | 8.0 g |
| Diethylene glycol | 40.0 g |
| 8-Mercaptoadenin | 0.07 g |

Water and potassium hydroxide were added to make the total volume 1 liter, and the pH was adjusted to 10.4.

| Composition of Fixing Solution (per 1 liter solution) | |
|---|---|
| Ammonium thiosulfate (70% aqueous solution) | 200 ml |
| Sodium sulfite | 22 g |
| Boric acid | 9.8 g |
| Sodium acetate trihydride | 34 g |
| Tartaric acid | 14.5 g |
| Aluminum sulfate (27% aqueous solution) | 25 ml |
| The pH was adjusted to 4.9 | |

Photographic materials were exposed with Type P-627 (a product of Dainippon Screen Co., Ltd). Processing was carried out according to the steps of insertion (2 sec.), developing (15 sec.), fixing (11 sec.), washing (6 sec.) and drying (11 sec.).

Further, a line-speed was changed so as to vary the total processing time as shown in Table 1, using an automatic processor, Type GR-680, a product of Konica Corporation, which was provided with modified racks.

Evaluation

Tone reproduction

Tone reproducibility was evaluated based on the percentage of the halftone dot formed when exposed through 95% halftone dot image in an exposing amount that gives 95% halftone dot image when exposed in contact with 5% dot image on a gray scale output from a scanner. The closer a value is to 5, the better is the tone reproduction.

Rank for paste-up marks

Using an exposed sample, with which the above-mentioned tone reproduction was evaluated, marks of the base and tape, which were pasted into the original were evaluated by visual observation. The best level is 10, level 4 is the lowest level for practical use and level 1 means practically of no use.

Obtained results are shown in Tables 1. As obvious from the Table, it is understood that the samples according to the present invention show improvements in the tone reproduction and paste-up mark.

TABLE 1

| Sample | Processing water Content: Emulsion Side ($g/m^2$) | Processing water Content: Backing Side ($g/m^2$) | Total Processing Time (sec) | General Formula H | Tone Reproduction Property | Level of Pasting-up Marks | Remarks |
|---|---|---|---|---|---|---|---|
| 1 | 8.0 | 8.0 | 60 | H-7 | 3.1 | 3 | Comp. |
| 2 | 8.0 | 8.0 | 45 | H-7 | 3.4 | 3 | Comp. |
| 3 | 6.0 | 6.0 | 45 | H-7 | 4.6 | 8 | Inv. |
| 4 | 6.0 | 6.0 | 25 | H-7 | 4.7 | 8 | Inv. |

Processing was further carried out, using guide materials as shown in Table 2, wherein the light-sensitive material used was the same one as used in Sample 3. Results thereof are shown below.

TABLE 2

| Sample No. | Processing water Content: Emulsion Side ($g/m^2$) | Processing water Content: Backing Side ($g/m^2$) | Total Processing Time (sec) | Sliding Friction (g) | Guide Material | Tone Reproduction Property | Level of Pasting-in Marks |
|---|---|---|---|---|---|---|---|
| 5 | 6.0 | 6.0 | 40 | 200 | ABS | 4.8 | 8 |
| 6 | 6.0 | 6.0 | 40 | 200 | PC | 4.7 | 7 |
| 7 | 6.0 | 6.0 | 40 | 700 | Rpl | 4.6 | 7 |

Furthermore, processing was carried out, varying the quality of hot-air and drying temperature, as shown in Table 3. Results thereof are shown below.

TABLE 3

| Sample No. | Processing water Content: Emulsion Side ($g/m^2$) | Processing water Content: Backing Side ($g/m^2$) | Total Processing Time (sec) | Quantity of Hot-air ($m^3/min$) | Drying Temperature (° C.) | Tone Reproduction Property | Level of Pasting-in Marks |
|---|---|---|---|---|---|---|---|
| 8 | 6.0 | 6.0 | 35 | 4.5 | 50 | 4.5 | 7 |
| 9 | 6.0 | 6.0 | 35 | 6.5 | 51 | 4.6 | 8 |

As obvious from the Table, the tone reproduction property and the level of paste-up mark were found to be good in the preferred range with respect to the quantity of hot-air and drying temperature.

What is claimed is:

1. A method of processing a silver halide photographic light-sensitive material comprising a support having on one side of the support, layers (I) including a silver halide emulsion layer and a hydrophilic colloid layer and, on the other side of the support, layers (II) including a hydrophilic colloid layer, said processing method comprising the steps of developing a light-exposed photographic material, fixing, the light-exposed photographic material and washing or stabilizing the fixed light-exposed photographic material, wherein at least one of the silver halide emulsion layer and hydrophilic layer included in the layers (I) contains a hydrazine compound represented by formula (Ha); and the layers (I) and the layers (II) each having a processing water content of 0.5 to 7.0 g per $m^2$, formula (Ha)

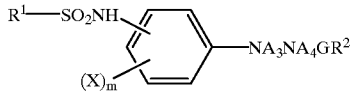

wherein $R^1$ is an aliphatic hydrocarbon group, aromatic hydrocarbon group or heterocyclic group; X is an alkyl group or a hydroxy group and m is an integer of 0 to 4; $A_3$ and $A_4$ are both hydrogen atoms, or one of them is a hydrogen atom and the other is an alkylsulfonyl group or acyl group; G is a carbonyl group, sulfonyl group, sulfoxy group, phosphoryl or iminomethylene group; $R_2$ is a hydrogen atom, alkyl group, alkenyl group, alkynyl group, aryl group, heterocyclic group, alkoxy group, hydroxy group, amino group, carbamoyl group or oxycarbonyl group.

2. The processing method of claim 1, wherein said method further comprises drying the washed or stabilized photographic material; said photographic material being processed with an automatic processor in a total processing time from developing to drying of 10–50 seconds.

3. The processing method of claim 2, wherein said automatic processor comprises a developing bath, a fixing bath, a washing bath or stabilizing bath, and a drying section; cross-over guide plates being provided respectively between an inlet for film insertion and the developing bath, between the developing bath and the fixing bath, between the fixing bath and the washing or stabilizing bath, and between the washing or stabilizing bath and the drying section; and at least one of the guide plates having a sliding friction of 10 to 1000 g.

4. The processing method of claim 2, wherein the drying is with hot air with a hot-air flow rate of 6 to 60 $m^3/min$.

5. The processing method of claim 2, wherein a temperature of the drying section is 5 to 60° C.

6. The processing method of claim 1 wherein said hydrazine compound is one of H-1 to H-8, H-10 to H-11, H-14 to H-15 and H-18 to H-25 as defined below:

H-1
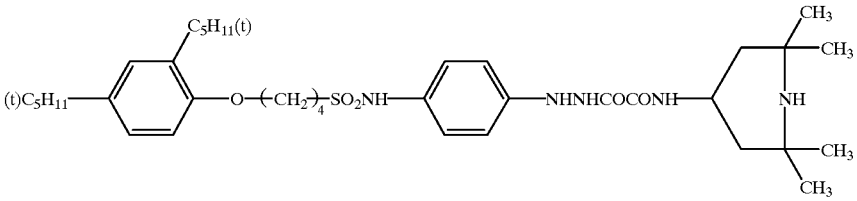
H-2
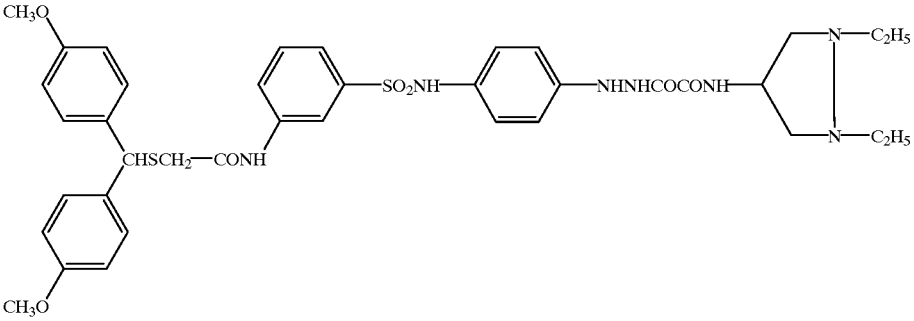
H-3
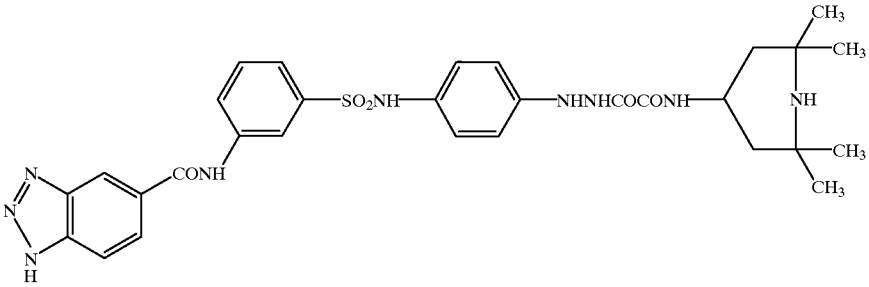
H-4
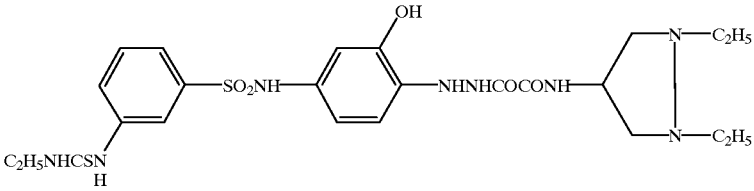
H-5
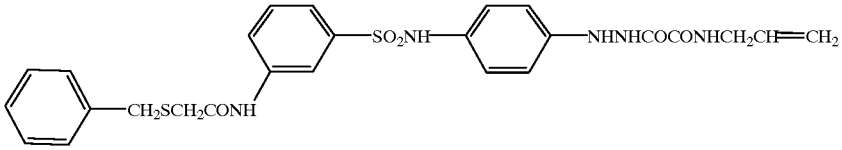
H-6
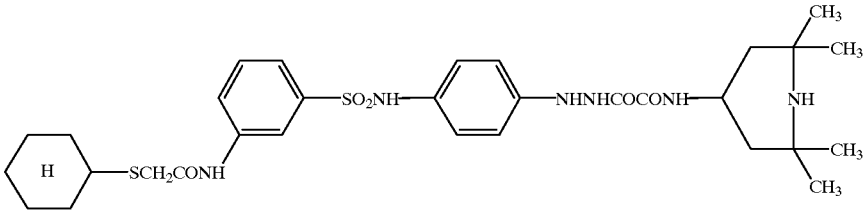

-continued
H-7
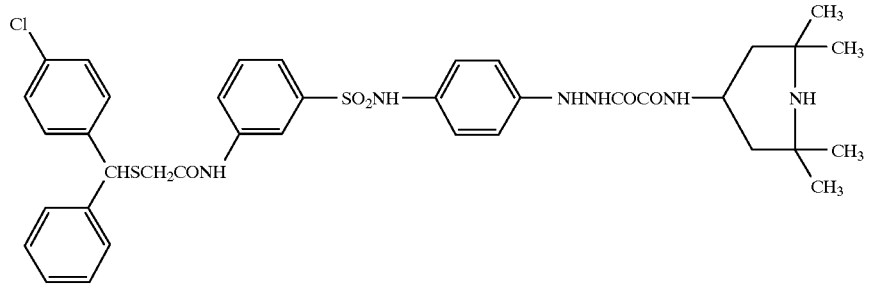
H-8
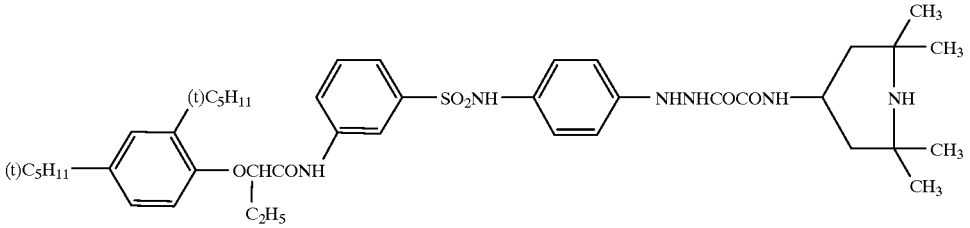
H-10
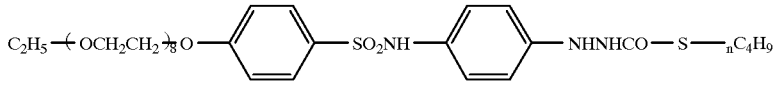
H-11
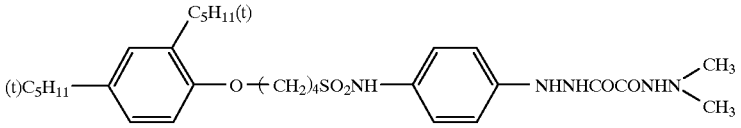
H-14
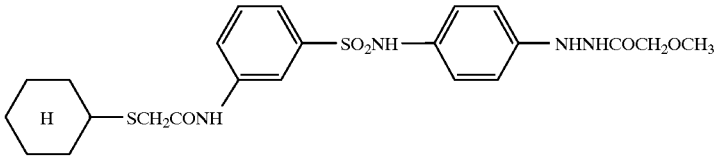
H-15
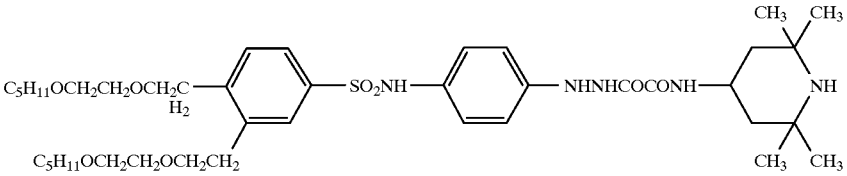
H-18
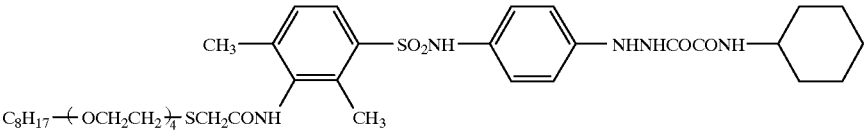

-continued
H-19
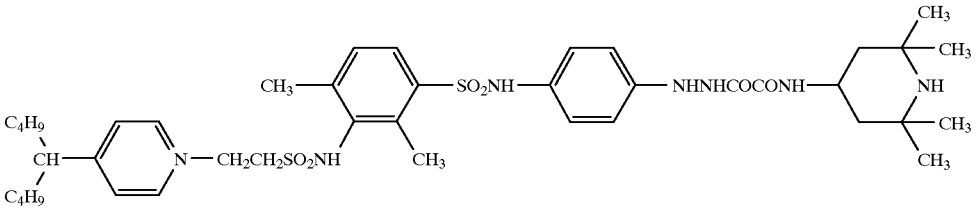
H-20
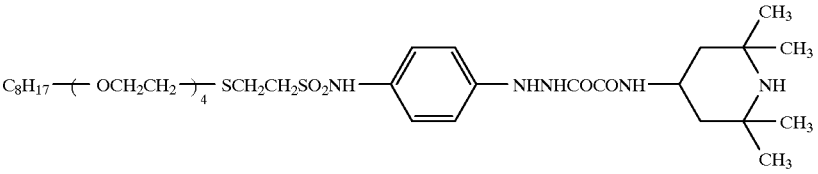
H-21
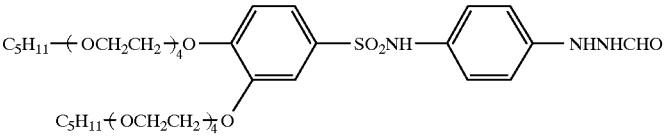
H-22
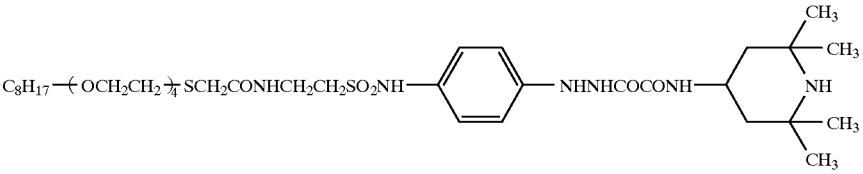
H-23
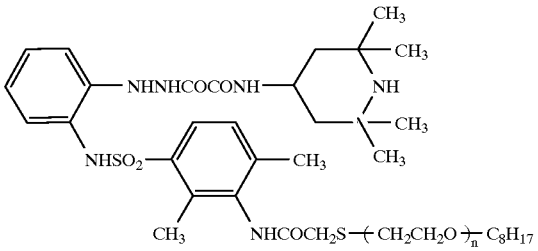
H-24
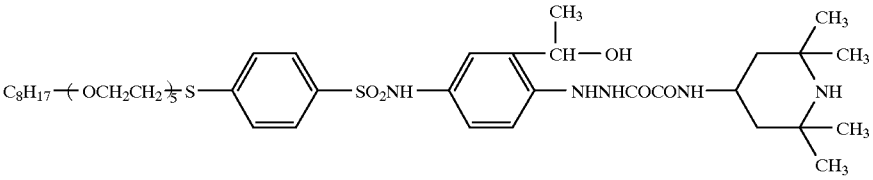
H-25
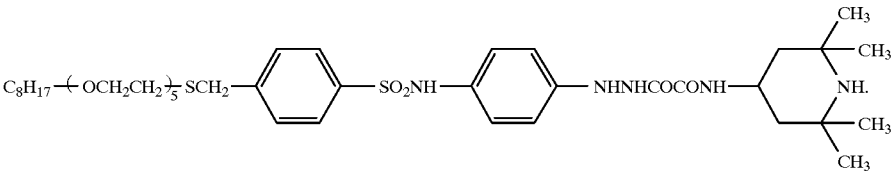
* * * * *